US007669969B2

(12) United States Patent
Shinada et al.

(10) Patent No.: US 7,669,969 B2
(45) **Date of Patent: *Mar. 2, 2010**

(54) INK-JET PRINTING APPARATUS AND INK CARTRIDGE THEREFOR

(75) Inventors: Satoshi Shinada, Nagano (JP); Fujio Akahane, Nagano (JP); Minoru Usui, Nagano (JP); Takao Kobayashi, Nagano (JP); Makoto Matsuzaki, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 154 days.

This patent is subject to a terminal disclaimer.

(21) Appl. No.: 11/761,179

(22) Filed: Jun. 11, 2007

(65) Prior Publication Data

US 2007/0247501 A1 Oct. 25, 2007

Related U.S. Application Data

(60) Continuation of application No. 11/343,773, filed on Jan. 30, 2006, now Pat. No. 7,246,882, which is a continuation of application No. 10/121,383, filed on Apr. 12, 2002, now Pat. No. 7,278,708, which is a division of application No. 09/484,458, filed on Jan. 18, 2000, now Pat. No. 6,502,917, which is a continuation-in-part of application No. PCT/JP99/02579, filed on May 18, 1999.

(30) Foreign Application Priority Data

| | | |
|---|---|---|
| May 18, 1998 | (JP) | 10-151882 |
| May 18, 1998 | (JP) | 10-151883 |
| Jun. 26, 1998 | (JP) | 10-180519 |
| Sep. 21, 1998 | (JP) | 10-266109 |
| Oct. 23, 1998 | (JP) | 10-301782 |
| Mar. 24, 1999 | (JP) | 11-078843 |

(51) Int. Cl.
*B41J 2/14* (2006.01)
*B41J 2/175* (2006.01)

(52) U.S. Cl. ..... 347/50; 347/86

(58) Field of Classification Search ..... 347/49, 347/50, 58, 86
See application file for complete search history.

(56) References Cited

U.S. PATENT DOCUMENTS 4,500,895 A 2/1985 Buck et al.

(Continued)

FOREIGN PATENT DOCUMENTS

AU 712 509 8/1997

(Continued)

OTHER PUBLICATIONS

Communication of a Notice of Opposition, European Patent 0 997 297 (Feb. 24, 2004).

(Continued)

*Primary Examiner*—Anh T. N. Vo
(74) *Attorney, Agent, or Firm*—Stroock & Stroock & Lavan LLP

(57) ABSTRACT

An ink jet type printing apparatus in which an ink supply needle is located near one side in a direction perpendicular to the reciprocated directions of a carriage, a circuit board is mounted on a wall of an ink cartridge in the vicinity of the side on which an ink supply port is formed and plural contacts for connecting to external control means are formed on the exposed surface of the circuit board.

4 Claims, 24 Drawing Sheets

U.S. PATENT DOCUMENTS 4,629,164 A 12/1986 Sommerville
4,633,274 A 12/1986 Matsuda
4,712,172 A 12/1987 Kiyohara et al.
4,780,095 A 10/1988 Classon et al.
4,806,103 A 2/1989 Kniese et al.
4,926,196 A 5/1990 Mizoguchi et al.
4,929,963 A 5/1990 Balazar
4,961,088 A 10/1990 Gilliland et al.
4,990,938 A 2/1991 Brandon et al.
4,999,652 A 3/1991 Chan
5,049,898 A 9/1991 Arthur et al.
5,137,379 A 8/1992 Ukai et al.
5,138,344 A 8/1992 Ujita
5,187,498 A 2/1993 Burger
5,208,610 A 5/1993 Su et al.
5,245,361 A 9/1993 Kashimura et al.
5,289,211 A 2/1994 Morandotti et al.
5,315,472 A * 5/1994 Fong et al. ..... 361/212
5,359,357 A 10/1994 Takagi et al.
5,363,134 A 11/1994 Barbehenn et al.
5,365,312 A 11/1994 Hillmann et al.
5,411,343 A 5/1995 Childers
5,414,452 A 5/1995 Accatino et al.
5,442,386 A 8/1995 Childers et al.
5,467,116 A 11/1995 Nakamura et al.
5,469,201 A 11/1995 Erickson et al.
D365,596 S 12/1995 Miyazawa et al.
5,491,540 A 2/1996 Hirst
5,497,178 A 3/1996 DeFosse et al.
D369,383 S 4/1996 Miyazawa et al.
5,506,611 A 4/1996 Ujita et al.
5,528,269 A 6/1996 Drogo et al.
5,610,635 A 3/1997 Murray et al.
5,623,293 A 4/1997 Aoki
5,640,186 A 6/1997 Swanson et al.
5,646,660 A 7/1997 Murray
5,684,518 A * 11/1997 Nobel et al. ..... 347/50
5,691,753 A 11/1997 Hilton
5,696,541 A 12/1997 Akahane et al.
5,699,091 A 12/1997 Bullock et al.
5,706,040 A 1/1998 Reid et al.
5,748,210 A 5/1998 Watanabe et al.
5,751,320 A 5/1998 Scheffelin et al.
5,788,388 A 8/1998 Cowger et al.
5,812,156 A 9/1998 Bullock et al.
5,835,817 A 11/1998 Bullock et al.
5,861,897 A 1/1999 Ide et al.
5,930,603 A 7/1999 Tsuji et al.
5,949,459 A 9/1999 Gasvoda et al.
5,975,677 A 11/1999 Marler et al.
6,000,788 A 12/1999 Iida
6,003,974 A 12/1999 Wilson et al.
6,011,937 A 1/2000 Chaussade et al.
6,017,118 A 1/2000 Gasvoda et al.
6,019,449 A 2/2000 Bullock et al.
6,019,461 A 2/2000 Yoshimura et al.
6,039,430 A 3/2000 Helterline et al.
6,065,824 A 5/2000 Bullock et al.
6,074,042 A 6/2000 Gasvoda et al.
6,102,517 A 8/2000 Kobayashi et al.
6,109,723 A 8/2000 Castle et al.
6,126,265 A 10/2000 Childers et al.
6,130,695 A 10/2000 Childers et al.
6,168,262 B1 1/2001 Clark et al.
6,170,939 B1 1/2001 Ujita et al.
6,170,940 B1 1/2001 Shinada et al.
6,196,670 B1 3/2001 Saruta
6,209,980 B1 4/2001 Kobayashi et al.
6,227,643 B1 5/2001 Purcell et al.
6,312,088 B1 11/2001 Seino
6,328,422 B1 12/2001 Watanabe et al.
6,361,138 B1 3/2002 Seino et al.
6,371,586 B1 4/2002 Saruta
6,375,298 B2 4/2002 Purcell et al.
6,416,152 B1 7/2002 Matsuzaki et al.
6,428,154 B1 8/2002 Kamiyama et al.
6,447,090 B1 9/2002 Saruta
6,502,916 B1 1/2003 Naka
6,631,967 B1 10/2003 Saruta
6,634,738 B1 10/2003 Shinada et al.
2001/0007458 A1 7/2001 Purcell et al.
2002/0015067 A1 2/2002 Studholme et al.

FOREIGN PATENT DOCUMENTS

CA 1252218 12/1984
CA 2 437 992 11/1999
CN 1160641 10/1997
CN 1057491 C 10/2000
CN 1091690 C 10/2002
DE 86 31 850 U1 4/1987
DE 4216021 A1 11/1993
DE 91 16 990.9 U1 1/1995
DE 19625466 C1 11/1997
DE 29711115 U 12/1997
EP 0 139 508 A2 5/1985
EP 0 276 403 A2 8/1988
EP 0 412 459 2/1991
EP 0 425 254 A2 2/1991
EP 0 440 110 A1 8/1991
EP 0 440 261 8/1991
EP 0 498 117 8/1992
EP 0 529 435 3/1993
EP 0 551 752 A2 7/1993
EP 0 553 535 A1 8/1993
EP 0 564 069 10/1993
EP 0 571 093 A2 11/1993
EP 0 606 047 A2 7/1994
EP 0 639 462 2/1995
EP 0 645 243 A2 3/1995
EP 0 655 336 A1 5/1995
EP 0 657 292 A1 6/1995
EP 0 709 209 A1 5/1996
EP 0 709 211 A1 5/1996
EP 0 710 568 5/1996
EP 0 713 778 5/1996
EP 0 721 171 A2 7/1996
EP 0 778 145 6/1997
EP 0 778 148 6/1997
EP 0 789 322 A2 8/1997
EP 0 812 693 12/1997
EP 0 813 120 A1 12/1997
EP 0 821 445 A1 1/1998
EP 0 822 084 A2 2/1998
EP 0 832 747 4/1998
EP 0 839 660 5/1998
EP 0 854 043 A2 7/1998
EP 0 940 260 9/1999
EP 0 960 736 A1 12/1999
EP 0 963 847 12/1999
EP 0 985 537 3/2000
EP 0 997 297 5/2000
EP 0 999 063 A2 5/2000
EP 1 004 449 A2 5/2000
EP 1 038 682 A1 9/2000
EP 1 080 917 A1 3/2001
JP 62-184856 8/1987
JP 02-099333 4/1990
JP 02-188246 A 7/1990
JP 03-067657 3/1991
JP 03-227629 A 10/1991
JP 04-133746 A 5/1992
JP 04-247955 9/1992
JP 04-275156 A 9/1992

| | | | |
|---|---|---|---|
| JP | 04-347655 | A | 12/1992 |
| JP | 05-45723 | | 2/1993 |
| JP | 05-084925 | A | 4/1993 |
| JP | 07-005839 | | 6/1993 |
| JP | 5-193127 | | 8/1993 |
| JP | 05-229137 | | 9/1993 |
| JP | 06-013100 | B2 | 2/1994 |
| JP | 06-064187 | A | 3/1994 |
| JP | 06-126981 | | 5/1994 |
| JP | 06-155758 | | 6/1994 |
| JP | 08-080618 | | 9/1994 |
| JP | 06-320750 | A | 11/1994 |
| JP | 07-040532 | A | 2/1995 |
| JP | 07-052377 | | 2/1995 |
| JP | 07-060953 | A | 3/1995 |
| JP | 07-081077 | | 3/1995 |
| JP | 07-232438 | | 9/1995 |
| JP | 07-232439 | | 9/1995 |
| JP | 07-246716 | A | 9/1995 |
| JP | 09-081050 | | 9/1995 |
| JP | 07-266577 | A | 10/1995 |
| JP | 07-314851 | A | 12/1995 |
| JP | 08-039791 | A | 2/1996 |
| JP | 08-039827 | A | 2/1996 |
| JP | 08-102820 | A | 4/1996 |
| JP | 08-132635 | | 5/1996 |
| JP | 08-197748 | | 8/1996 |
| JP | 2594912 | B2 | 12/1996 |
| JP | 09 169123 | | 6/1997 |
| JP | 09-174876 | | 7/1997 |
| JP | 09-174879 | | 7/1997 |
| JP | 09-193410 | | 7/1997 |
| JP | 09-286124 | A | 11/1997 |
| JP | 10-024607 | A | 1/1998 |
| JP | 10-034965 | | 2/1998 |
| JP | 10-146680 | | 6/1998 |
| JP | 10-151882 | | 6/1998 |
| JP | 10-151883 | | 6/1998 |
| JP | 2000-177145 | | 6/2000 |
| WO | 90/00974 | | 2/1990 |
| WO | 96/05061 | | 2/1996 |
| WO | 97/23352 | A1 | 7/1997 |
| WO | 97/28001 | | 8/1997 |
| WO | 98/04414 | | 2/1998 |
| WO | 98/52762 | | 11/1998 |
| WO | 98/55318 | | 12/1998 |
| WO | 98/55322 | | 12/1998 |
| WO | 98/55323 | | 12/1998 |
| WO | 98/55324 | | 12/1998 |
| WO | 98/55325 | | 12/1998 |
| WO | 99/65695 | | 12/1999 |
| WO | 00/21756 | A1 | 4/2000 |
| WO | 00/26034 | A2 | 5/2000 |
| WO | 00/47417 | A1 | 8/2000 |
| WO | 01/54910 | A2 | 8/2001 |
| WO | 02/11986 | A2 | 2/2002 |

OTHER PUBLICATIONS

English Translation of portions of Notice of Opposition and Brief Communication in European Patent 0 997 297 (Mar. 2, 2004).
Office Action from JP 2002-229479 (Sep. 29, 2003).
Search Report dated Oct. 19, 2004 in European Patent Appln. 03 024 553.4.
Search Report dated Oct. 6, 2004 in European Patent Appln. 04 004 435.6.
Decision of Grant, dated Feb. 26, 2001, in Russian Patent Appln. 2000103956.
Notice of Acceptance of Request for Invalidation in Chinese Pat. No. 00131800.4 (Jun. 1, 2005), and English translation.
Office Action in JP 11-125070 (date not ascertained).
English Translation of Office Action from Japanese Appln. 11-125070.
Presentation "Large Format Printing With HP JetExpress Technology Hewlett-Packard, 1999", Dr. Ross R. Allen (marked "Anlage [Exhibit] L7") (pp. 1-25) and cleaner copy of same (pp. 1-27).
Druckspiegel (Feb. 1999) (cover, pp. 3-4, 14, 58) (marked "Anlage [Exhibit] L8").
HP DesignJet Groβformatdruker Für CAD/GIS-Anwendungen (2 pgs) (date not legible) (marked "Anlage [Exhibit] L8a").
Large Output, No. 5 (2 pgs) (1999) (marked "Anlage [Exhibit] L8b").
Presentation "Inkjet in the Office or Home—No Marked Differences or Different Materials", Rob Beeson, Hewlett Packard Company (Mar. 25, 1999, Hamburg, Germany) (marked "Anlage [Exhibit] D13").
Notice of Acceptance of Request for Invalidation in Chinese Patent 00131800.4 (Dec. 20, 2005), with English translation.
Notice of Acceptance of Request for Invalidation in Chinese Patent 00131800.4 (Jan. 18, 2006), with English translation.
Notice of Acceptance of Request for Invalidation in Chinese Patent 00131800.4 (Apr. 24, 2006), with English translation.
Notice of Investigation of the U.S. International Trade Commission in the Matter of Certain Ink Cartridges and Components Thereof, Inv. No. 337-TA-565 (Mar. 17, 2006) (unsigned).
Respondent Ninestar Technology Co. Ltd.'s (Zhuhai) Third Supplemental Responses to Complainant's First and Second Sets of Interrogatories (Nos. 16-19 . . . and 146) (including Exhibits A-C), U.S. ITC Investigation No. 337-TA-565 (Aug. 18, 2006).
Respondent Ninestar Technology Co. Ltd.'s Third Supplemental Responses to Complainant's First and Second Set of Interrogatories (Nos. 21-24 . . . 138-145), U.S. ITC Investigation No. 337-TA-565 (Aug. 18, 2006).
Respondent Town Sky Inc.'s Third Supplemental Responses to Complainant's First and Second Set of Interrogatories (Nos. 21-24 . . . 138-145), U.S. ITC Investigation No. 337-TA-565 (Aug. 18, 2006).
Respondent Dataproducts USA LLC's Second Supplemental Objections and Responses to Complainant's First Set of Interrogatories, U.S. ITC Investigation No. 337-TA-565 (Aug. 16, 2006).
Respondent Dataproducts USA LLC's Second Supplemental Objections and Responses to Complainant's Second Set of Interrogatories, U.S. ITC Investigation No. 337-TA-565 (Aug. 16, 2006).
Artech's Preliminary Proposed Claim Constructions, ITC Inv. No. 337-TA-565 (3 pgs.).
Artech's Preliminary Non-Infringement Claim Charts, ITC Inv. No. 337-TA-565 (18 pgs.).
Artech's Preliminary Invalidity Claim Charts, ITC Inv. No. 337-TA-565 (20 pgs.).
U.S. Appl. No. 09/318,268, filed May 25, 1999, Matsumoto et al.
U.S. Appl. No. 09/432,272, filed Nov. 2, 1999, Saruta et al.
U.S. Appl. No. 09/442,646, filed Nov. 18, 1999, Saruta et al.
Decision of Request for Invalidation of Chinese patent No. 00131800.4 (Apr. 16, 2008), with partial English translation.
Foreign Office Action dated Mar. 18, 2009 for application No. 2006-138938.
Foreign Office Action dated Mar. 18, 2009 for application No. 2006-138940.
Foreign Office Action dated Mar. 24, 2009 for application No. 11-557793.
Foreign Office Action dated Mar. 25, 2009 for application No. 2002-188232.
Office Action, dated Mar. 16, 2009, in European Pat. Appln. No. 07 019 631.6.
Office Action, Mar. 17, 2009, in European Pat. Appln. No. 07 019 630.8.
Extended Examination and Search Report, dated Mar. 27, 2009, in European Pat. Appln. No. 08 015 694.6.
Extended Examination and Search Report, dated Mar. 30, 2009, in European Pat. Appln. No. 08 015 693.8.
Decision on Appeal issued in corresponding European Pat. No. 0 997 297, dated Mar. 30, 2009.
Office Action dated Jun. 24, 2009 issued in JP Pat. App. No. 2008-214959.
European Search Report Jan. 11, 2001.
European Search Report Jan. 15, 2001.

German Language document "Date Up", cover, pg. 11, two unnumbered pages, plus complete English translation, (publication date unknown).

German Languague document "Date Up 98/1", cover, pp. 2-5, 22 and two unnumbered pages, plus complete English translation, (publication date unknown).

Notice of Reasons for Rejection issued on Jul. 15, 2009 in corresponding Japanese Patent Application No. 2002 188232, with English translation.

Notice of Reasons for Rejection issued on Jul. 15, 2009 in corresponding Japanese Patent Application No. 2006-138938, with English translation.

Notice of Reasons for Rejection issued on Jul. 15, 2009 in corresponding Japanese Patent Application No. 2002 138940, with partial English translation.

Official Minutes and Decision issued on Jun. 26, 2009 in corresponding German application DE 199 64 216.8 with English translation.

* cited by examiner (a)

(b)

(a)

(b)

(a)

(b)

(a)

(b)

(a)

(b)

(a)

(b)

(a)

(b)

(c)

(a)

(b)

(a)

(b)

(a)

(b)

INK-JET PRINTING APPARATUS AND INK CARTRIDGE THEREFOR

CROSS-REFERENCE TO RELATED APPLICATIONS

This application is a continuation of copending application Ser. No. 11/343,773, filed Jan. 30, 2006, now U.S. Pat. No. 7,246,882, which is a continuation of copending application Ser. No. 10/121,383, filed Apr. 12, 2002 now U.S. Pat. No. 7,278,708, which is a division of application Ser. No. 09/484,458, filed Jan. 18, 2000, now U.S. Pat. No. 6,502,917, which is a continuation-in-part of PCI Application No. PCT/JP99/02579, filed May 18, 1999, which claims benefit of priority based on Japanese Patent Application Nos. 10-151883 and 10-151882, both filed May 18, 1998, 10-180519, filed Jun. 26, 1998, 10-266109, filed Sep. 21, 1998, 10-301782, filed Oct. 23, 1998, and 11-78843, filed Mar. 24, 1999.

BACKGROUND OF THE INVENTION

1. Field of the Invention

The present invention relates to a printing apparatus to which ink is supplied from a replaceable ink cartridge for printing on a recording medium, ejecting an ink droplet from nozzle apertures and an ink cartridge suitable for the above printing apparatus.

2. Conventional Art

An ink-jet printing apparatus is known in which there is provided with a print head for supplying a driving signal to a piezoelectric vibrator or heating means to print data, pressurizing ink by energy generated by the piezoelectric vibrator or the heating means and thereby ejecting ink droplets from nozzle apertures and an ink cartridge housing ink for supplying ink to the above print head.

As the print quality depends upon the resolution of the print head and greatly depends upon the viscosity of ink, the degree of bleeding on a recording medium or the like, the characteristics of ink are improved to enhance the print quality. Even if the same ink is used, a driving method of a print head suitable for the characteristics of ink is improved to enhance the print quality. Further, a maintenance condition such as the cycle of no-medium-ejection or forced ejection in a capping state is improved to prevent the nozzle apertures from clogging.

As described above, the print quality of a printing apparatus can be enhanced when the ink characteristics and the driving method for a print head work together, not only by the ink characteristics. Although a result by such technical development can be applied to a newly manufactured ink-jet printing apparatus, the application to a printing apparatus already shipped from a manufacturer would be practically impossible when taking into consideration the cost, labor and others. This is because that the printing apparatus has to be carried to the manufacturer and storing means in which control data is recorded must be exchanged.

To cope with such a problem, as disclosed in Japanese Patent Publication No. 2594912 for example, there has been proposed a printing apparatus in which semiconductor storage means and an electrode connecting to the storage means are arranged on an ink cartridge, a group of electrodes is also arranged on the body of the printing apparatus, data stored in the semiconductor storage means is read, and recording operation is controlled in accordance with the data.

However, there is a problem that contact with the semiconductor storage means is failed because of rough operation for attaching or detaching an ink cartridge by a user or play between a carriage and an ink cartridge, the reading of data is disabled because of electrification or the application of a signal at unsuitable timing and, in the worst case, data is lost and recording operation is disabled.

The present invention is made in view of such a problem and an object of which is to provide an ink-jet printing apparatus wherein data stored in semiconductor storage means can be prevented from being lost independent of unsuitable operation for attaching or detaching an ink cartridge.

Another object of the present invention is to provide an ink cartridge suitable for the above printing apparatus.

DETAILED DESCRIPTION OF THE INVENTION

Figure 1:
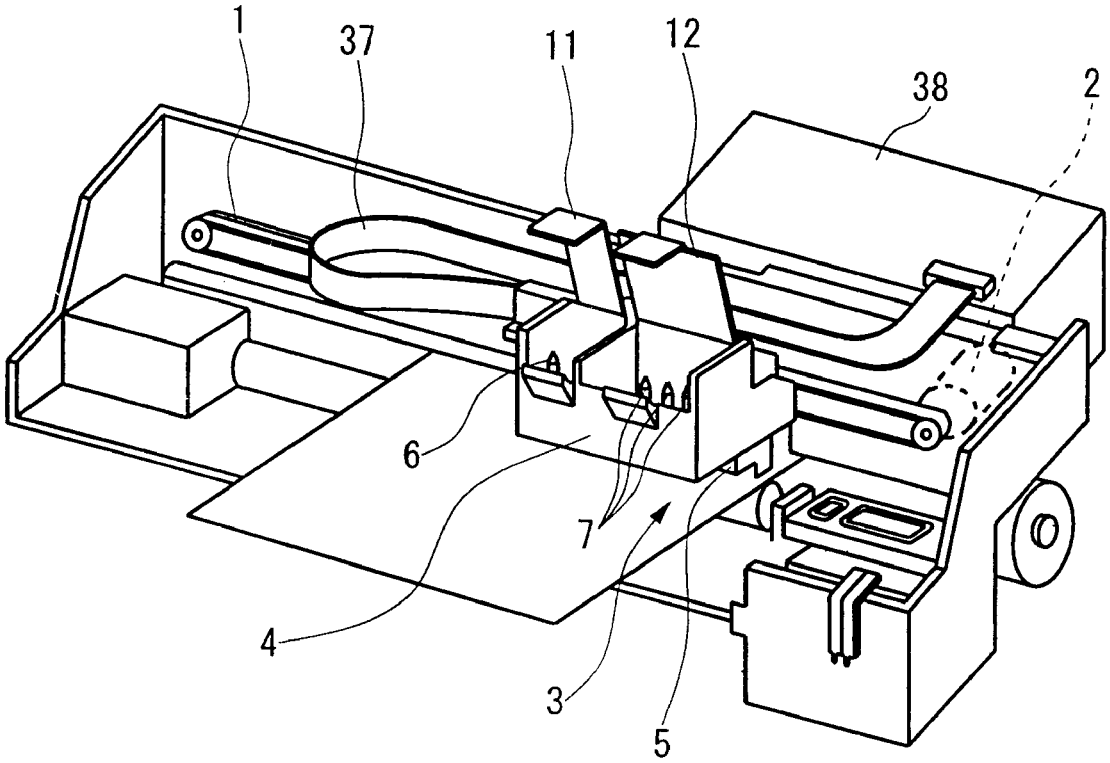
FIG. 1 shows an embodiment of a printing apparatus according to the present invention mainly in relation to its recording mechanism.

FIG. 1 shows one embodiment of an ink-jet printing apparatus according to the present invention with respect to a printing mechanism. A holder 4 for installing a black ink cartridge 40 housing black ink described later and a color ink cartridge 50 housing color ink is disposed on an upper surface of a carriage 3 connecting to a driving motor 2 via a timing belt 1. A print head 5 to which ink is supplied from each ink cartridge is provided on the lower surface of the carriage 3.

Figure 2:
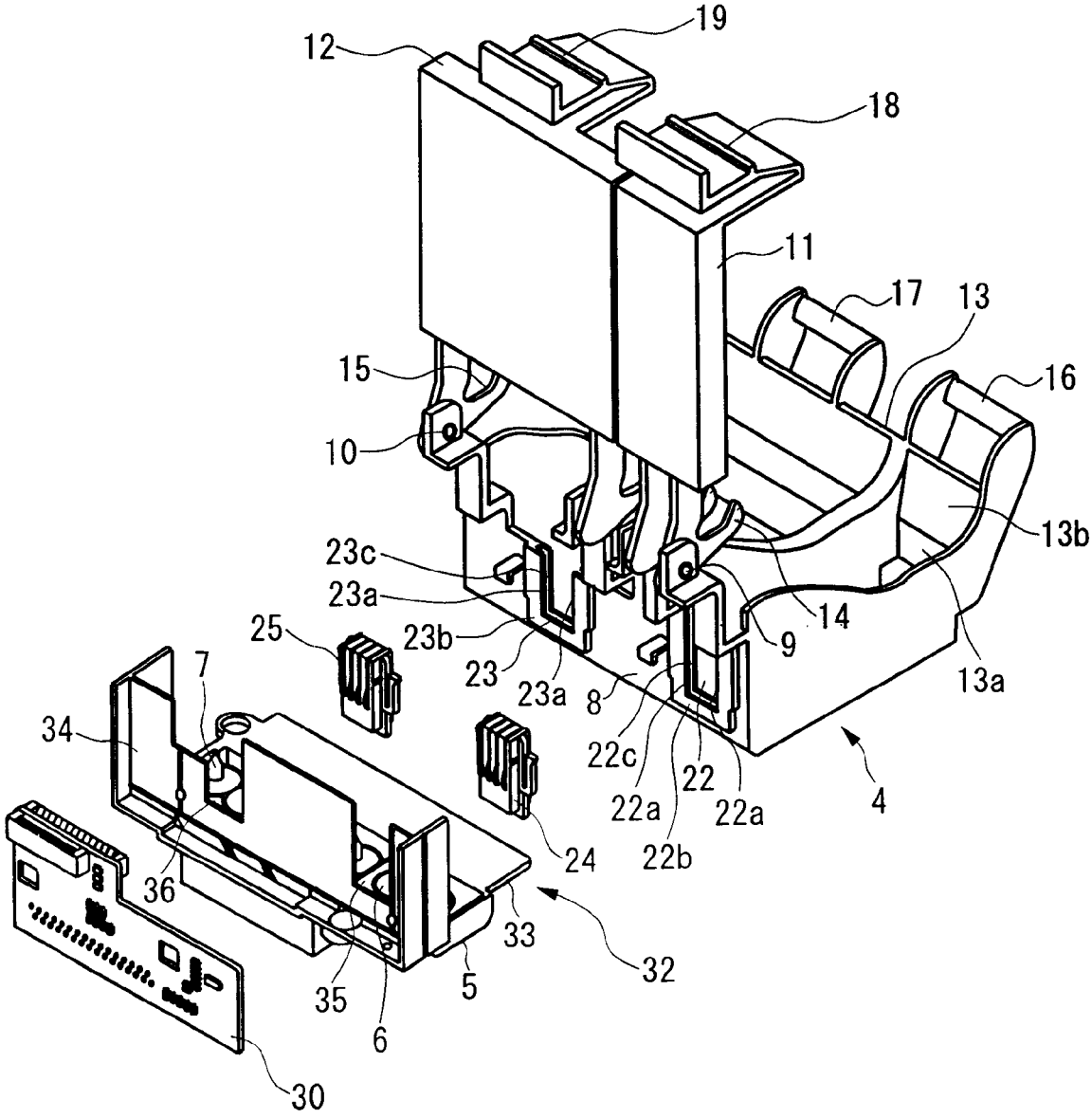
FIG. 2 is an assembly perspective drawing showing an embodiment of a carriage in the above printing apparatus.
Figure 3:
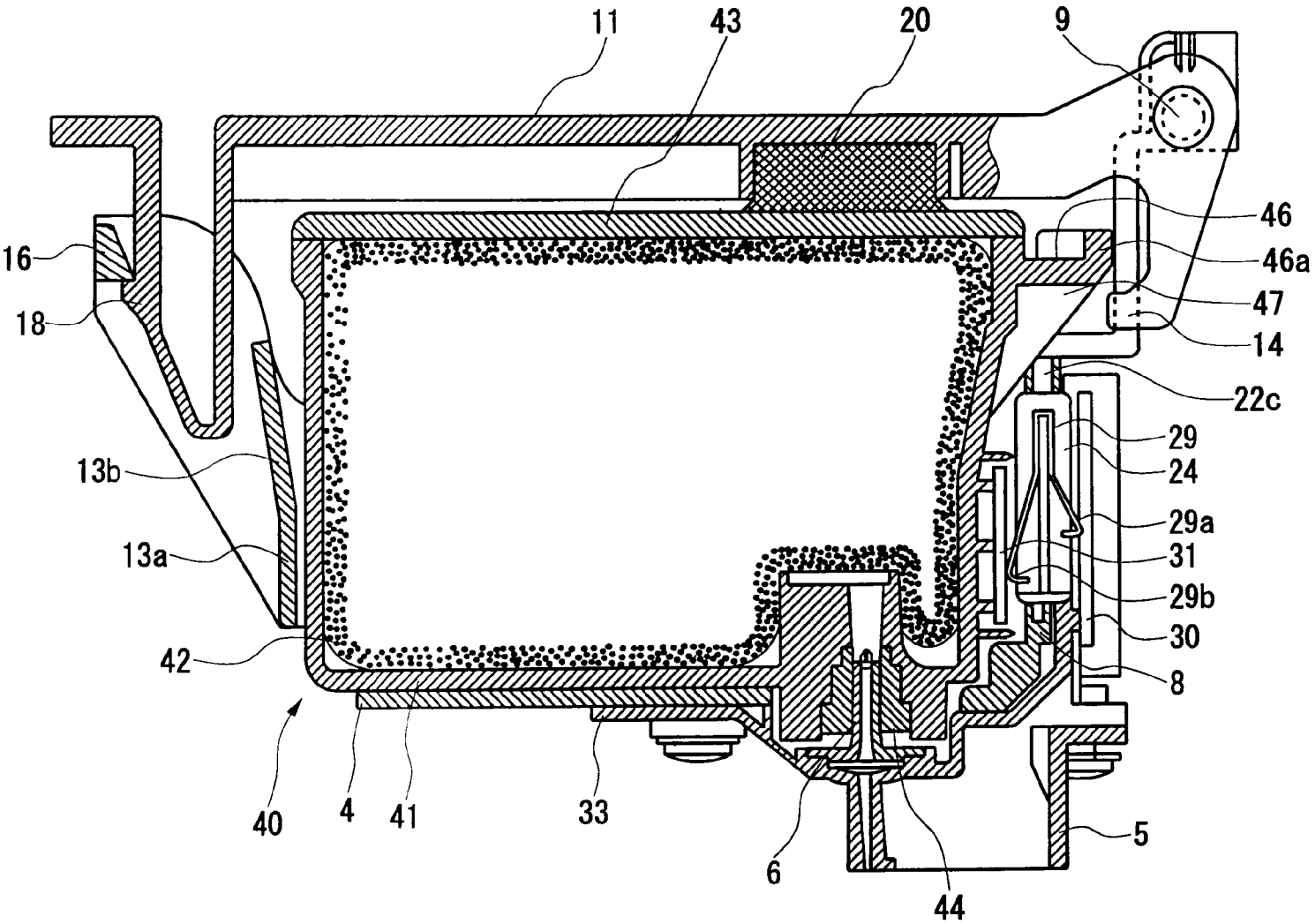
FIG. 3 shows an embodiment of the carriage in the above printing apparatus in a state in which an ink cartridge is installed.

FIG. 2 shows an embodiment of the carriage in a state in which the carriage is disassembled into a holder part and a head part and FIG. 3 is a sectional structural view sectioned at an ink supply port 44 of the black ink cartridge 40.

Ink supply needles 6 and 7 communicating with the print head 5 are vertically penetrated in the bottom of the carriage 3 so that they are located on the back side of the device, that is, on the side of the timing belt 1. Levers 11 and 12 are respectively mounted at the upper end of a vertical wall 8 opposite to each vicinity of the ink supply needles 6 and 7 out of the vertical wall forming the holder 4 so that the levers are respectively rotatable along shafts 9 and 10. A wall 13 located on the side of each free end of the levers 11 and 12 is composed of a vertical part 13*a* near the bottom and a sloped part 13*b* sloped outward in its upper area.

The levers 11 and 12 respectively extend from the vicinity of the shafts 9 and 10 so that projections 14 and 15 respectively fitted to overhangs 46 and 56 described later at the upper end of the ink cartridges 40 and 50 are approximately perpendicular to each body of the respective levers 11 and 12, and hook portions 18 and 19 elastically fitted to hooks 16 and 17 formed in the sloped part 13*b* of the holder 4 are respectively formed.

Figure 4:
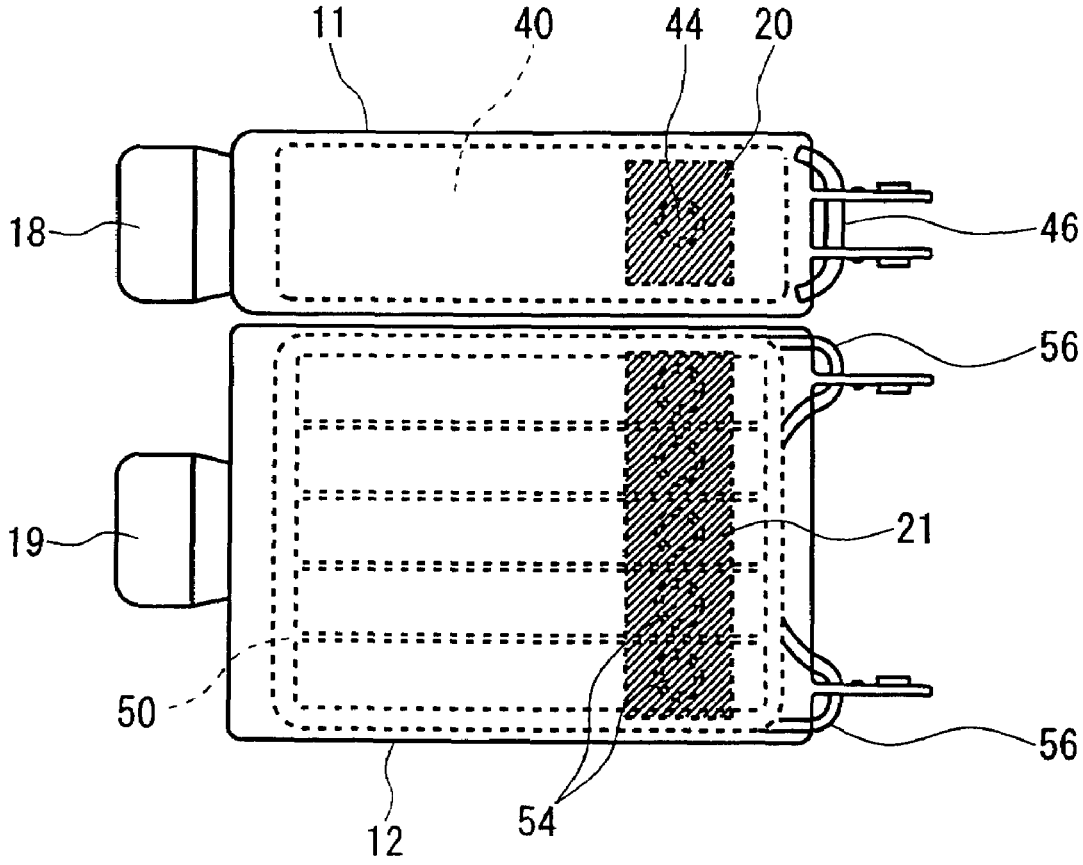
FIG. 4 is a top view showing an embodiment of the carriage in the above printing apparatus in a state in which an ink cartridge is installed, and FIGS. 5(*a*) and 5(*b*) show an embodiment of a contact mechanism of the above carriage.

Elastic members 20 and 21 for elastically pressing at least the area opposite to the ink supply port 44 or 54 of each ink cartridge 40 or 50, as shown in FIG. 4, when the ink cartridge 40 is set in a normal position are provided to the back of each lever 11 or 12, that is, the face opposite to a cover 43 of the ink cartridge 40.

For these elastic members 20 and 21, material having the coefficient of friction of 0.5 or more for the respective covers 43 and 53 of the ink cartridges 40 and 50, for example, rubber the hardness of which is 10° to 70°, foamed material and a felt member and, further, gelled material are employed.

Windows 22 and 23 each upper part of which is open are respectively formed on the vertical wall 8 located near the ink supply needle. Further, continuous grooves 22*c* and 23*c* are respectively formed on vertical walls 22*a* and 23*a* and at the bottoms 22*b* and 23*b* to respectively form each window, and contact mechanisms 24 and 25 are respectively inserted into these grooves 22*c* and 23*c* and fixed therein.

Figure 5:
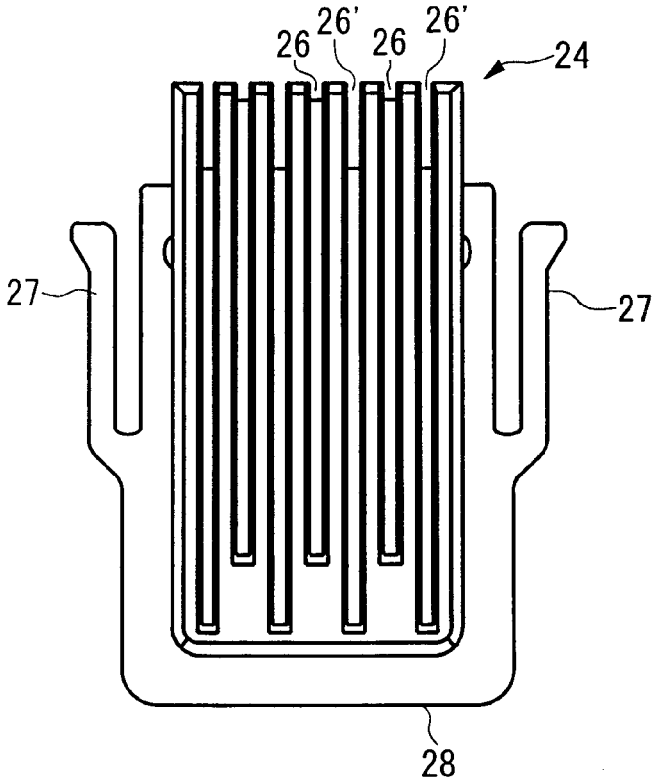
Figure 5:
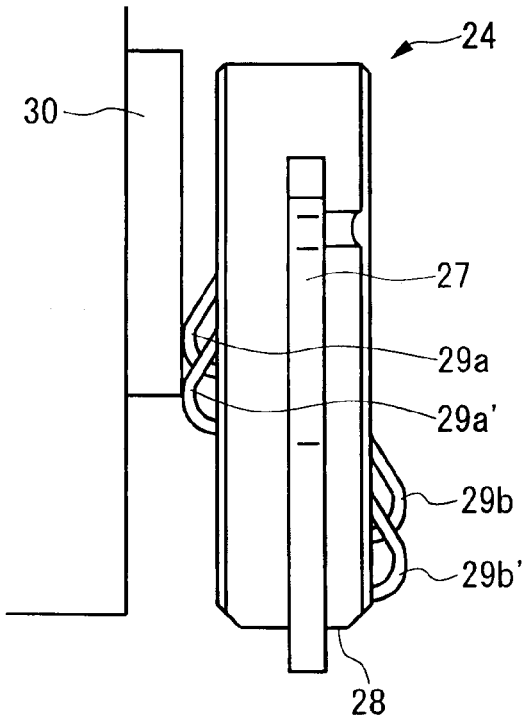

As the contact mechanisms 24 and 25 are composed so that they have approximately the same structure, one contact mechanism 24 will be described below. As shown in FIGS. 5(*a*) and 5(*b*), two types of slits 26 and 26' different in depth are formed approximately at fixed pitch, the contact forming members 29 and 29' provided with conductivity and elasticity are fitted into each slit 26 or 26' of the body 28 provided with an elastically transformable pawl 27 on both sides. These contact forming members 29 and 29' are respectively located unevenly and fixed so that they are exposed on the superficial and rear sides of the body 28.

Areas 29*a* and 29'*a* exposed from each one face of the contact forming members 29 and 29' respectively elastically come in contact with the contact of a circuit board 30 by composing the contact mechanisms 24 and 25 as described above and fitting the circuit board 30 in front of a vertical wall 34 of a base 32, areas 29*b* and 29'*b* exposed from the other face respectively elastically come in contact with the contact of a circuit board 31 described later of the ink cartridges 40 and 50, and conduction is acquired.

In the meantime, the print head 5 is fixed to the bottom of the holder 4 via a horizontal part 33 of the base 32 composed together with the ink supply needles 6 and 7 so that the base is approximately L-type. Windows 35 and 36 are respectively formed in areas opposite to the contact mechanism 24 and 25 on the vertical wall 34 of the base 32 and the above circuit board 30 is held on its front side.

The circuit board 30 is connected to control means 38 via a flexible cable 37 shown in FIG. 1, supplies a driving signal for instructing the print head 5 to jet an ink droplet and comes in contact with the circuit board 31 of the ink cartridges 40 and 50 respectively via the contact mechanisms 24 and 25.

Figure 6:
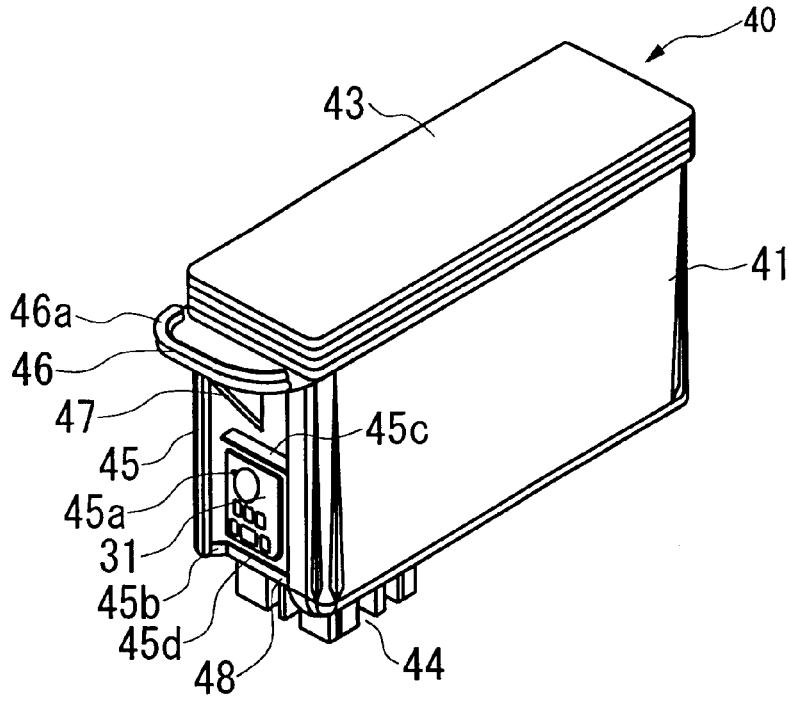
FIGS. 6(*a*) and 6(*b*) show an embodiment of an ink cartridge suitable for the above printing apparatus, FIGS. 7(*a*) to 7(*c*) show an embodiment of a circuit board mounted on the ink cartridge in relation to its superficial and rear structure and the size of an electrode and FIGS. 7(*d*) and 7(*e*) show a state of contact with a contact.
Figure 6:
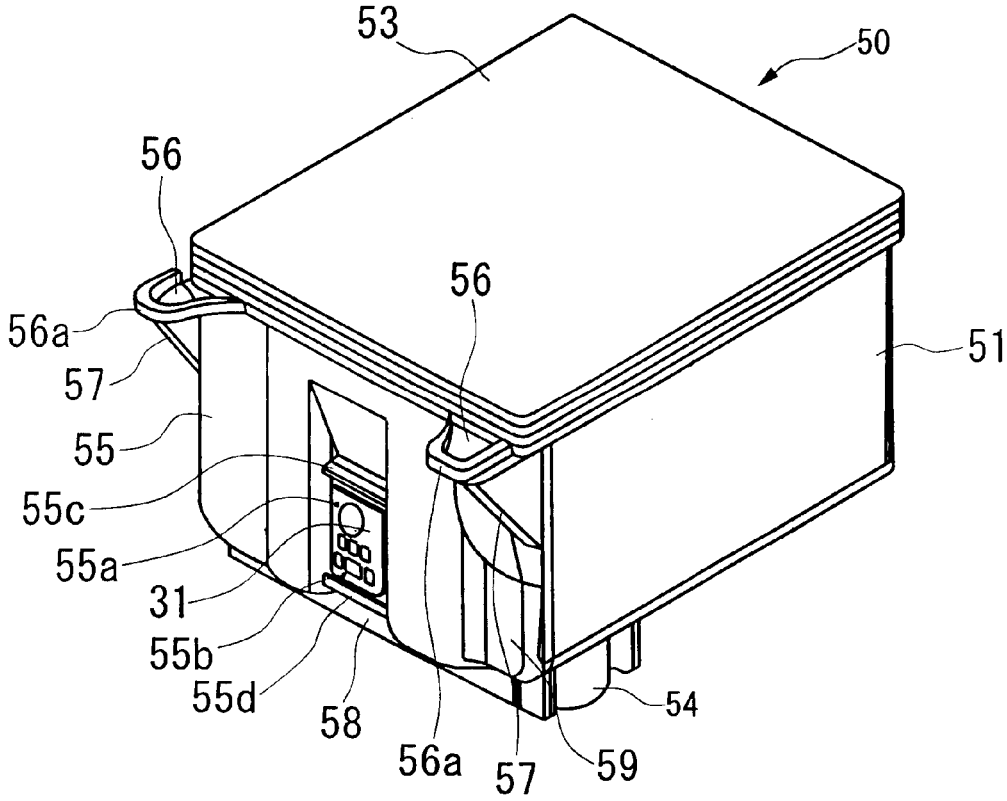

FIGS. 6(*a*) and 6(*b*) show an embodiment of the black ink cartridge 40 and the color ink cartridge 50, a porous member 42 impregnated with ink is respectively housed in containers 41 and 51 formed so that they are substantially rectangular parallelepiped and the respective upper faces are respectively sealed by the covers 43 and 53.

The ink supply ports 44 and 54 are respectively formed in positions opposite to the ink supply needles 6 and 7 when the ink cartridges are respectively installed in the holder 4 at the bottom of the respective containers 41 and 51, and overhang portions 46, 56 and 56 for fitting in the respective projections 14 and 15 of the levers 11 and 12 are integrated with the respective upper ends of the vertical walls 45 and 55 on the side of the ink supply ports. As shown in FIGS. 6(*a*) and 6(*b*), the overhang portions 46, 56 protrude from the housing of the ink cartridges 40, 50, respectively, in a direction perpendicular to a plane of the circuit board 31. The overhang portion 46 of the black ink cartridge 40 is continuously formed from one end to the other end, the overhang portion 56 of the color ink cartridge 50 are individually formed so that they are located on both sides and, further, triangular ribs 47 and 57 are respectively formed between each lower surface and the wall 45 or 55. A reference number 59 denotes a concave portion for preventing wrong insertion.

Concave portions 48 and 58 are respectively formed on the vertical walls 45 and 55 on the side of the ink supply ports so that the concave portions are respectively located in the center of the width of the ink cartridges 40 and 50 and the circuit boards 31 are respectively installed in the above concave portions.

As best shown in FIGS. 6(*a*) and 6(*b*), the circuit boards 31 is attached on a side wall having the shorter width than the other side wall of the ink cartridges 40 and 50 and located on a central line of the ink supply ports 44 and 54, respectively. The circuit board 31 is disposed substantially in parallel with the side wall. In addition, as shown in FIG. 6(*b*), the ink cartridge 50 is provided with a plurality of ink chambers for different ink, and the circuit board 31 is disposed substantially at a center of the total width of the plurality of the ink chambers. Because the circuit boards 31 are located as described above, the accurate positional relationship of the circuit boards 31 with the contact member of the printing apparatus can be assured when the ink cartridges 40 and 50 are mounted on the printing apparatus.

Further, it is preferable that the height or depth of the concave portions in which the circuit boards 31 are to be installed is higher than that of the circuit board 31. Alternately, a plane of the circuit boards 31 is aligned with a surface of the side wall of the ink cartridge 40, 50 on which the circuit boards 31 are disposed. Because of these arrangement, the circuit boards 31 can be prevented from being touched by a user's finger when the ink cartridge is mounted on the printing apparatus.

Figure 7:
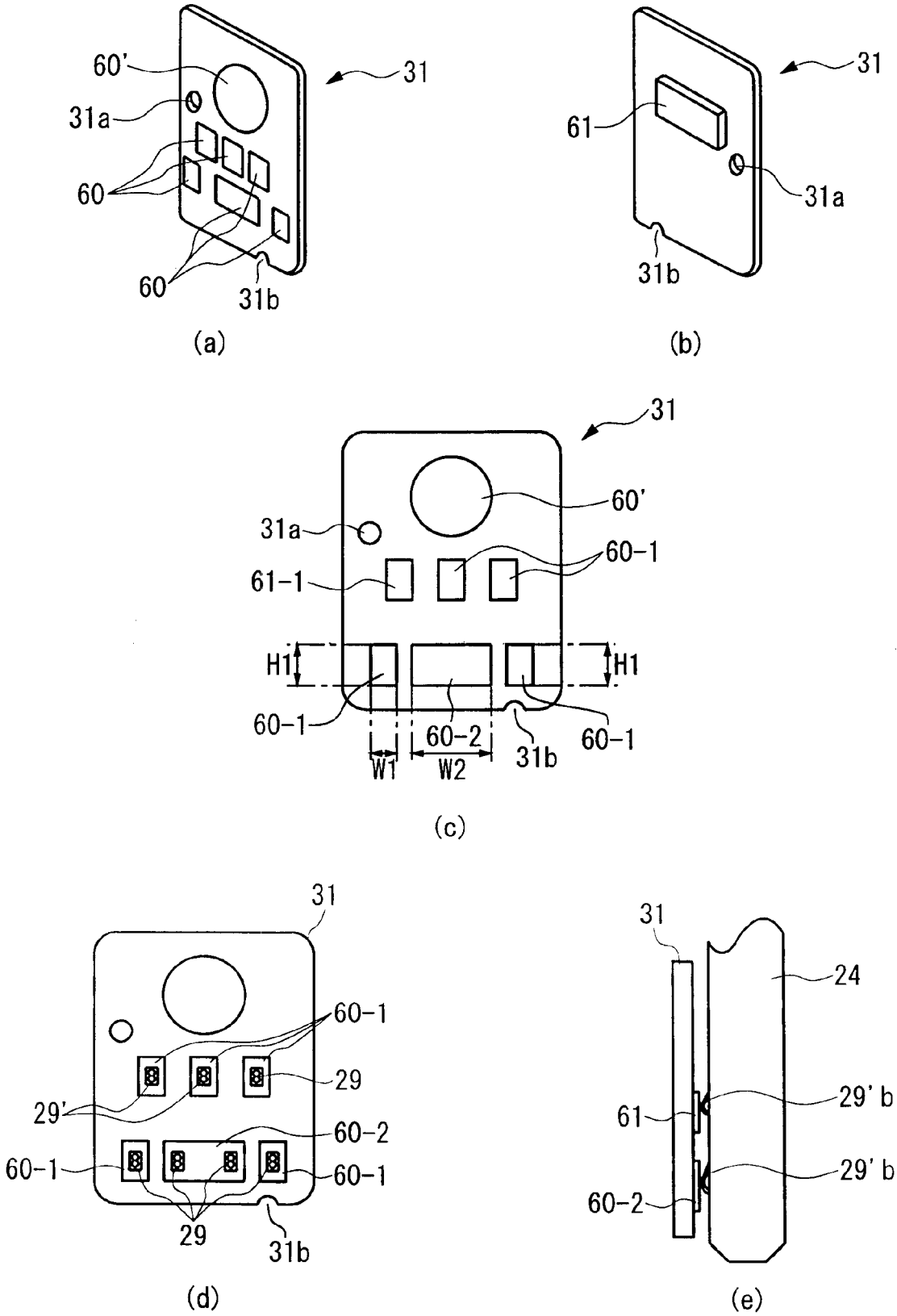

Contacts 60 in plural rows in a direction in which the cartridge is inserted, in two rows in this embodiment, are formed in a position respectively opposite to the contact forming members 29 and 29' of the above contact mechanism 24 on the side of the surface when the circuit board is attached to the ink cartridge of the circuit board 31 as shown in FIG. 7(*a*). A semiconductor storage means 61 may be mounted at the rear surface of the circuit board 31 so that the semiconductor storage means is connected to these contacts 60 and, if necessary, is molded by ink-resistant material and is kept unexposed. The semiconductor storage means 61 may store data of the quantity of ink housed in the ink cartridge 40 or 50 to which the semiconductor storage means is provided, the manufacturing date of the ink, its trademark and the like. If required, the semiconductor storage means 61 stores data such as a maintenance status transmitted from the body of the printing apparatus. A reference number 60' denotes an electrode used for a check during its manufacturing process. The electrode 60' is grounded when used.

As shown in FIG. 7, the electrodes 60 are distanced from an edge of the circuit board 31 or from a position of the circuit board where a contact member of the printing apparatus first comes into abutment when the ink cartridge is mounted on the printing apparatus. Such arrangement is advantageous in that the electrodes 60 on the circuit board 31 can be protected from a damage which might be given to the electrodes 60 when the circuit board 31 comes into abutment with the contact member of the printing apparatus. Further, since the electrodes 60 are distanced from the edge of the circuit board 31, it is easy to control the position of the circuit board 31 with respect to the contact member of the printing apparatus.

Figure 11:
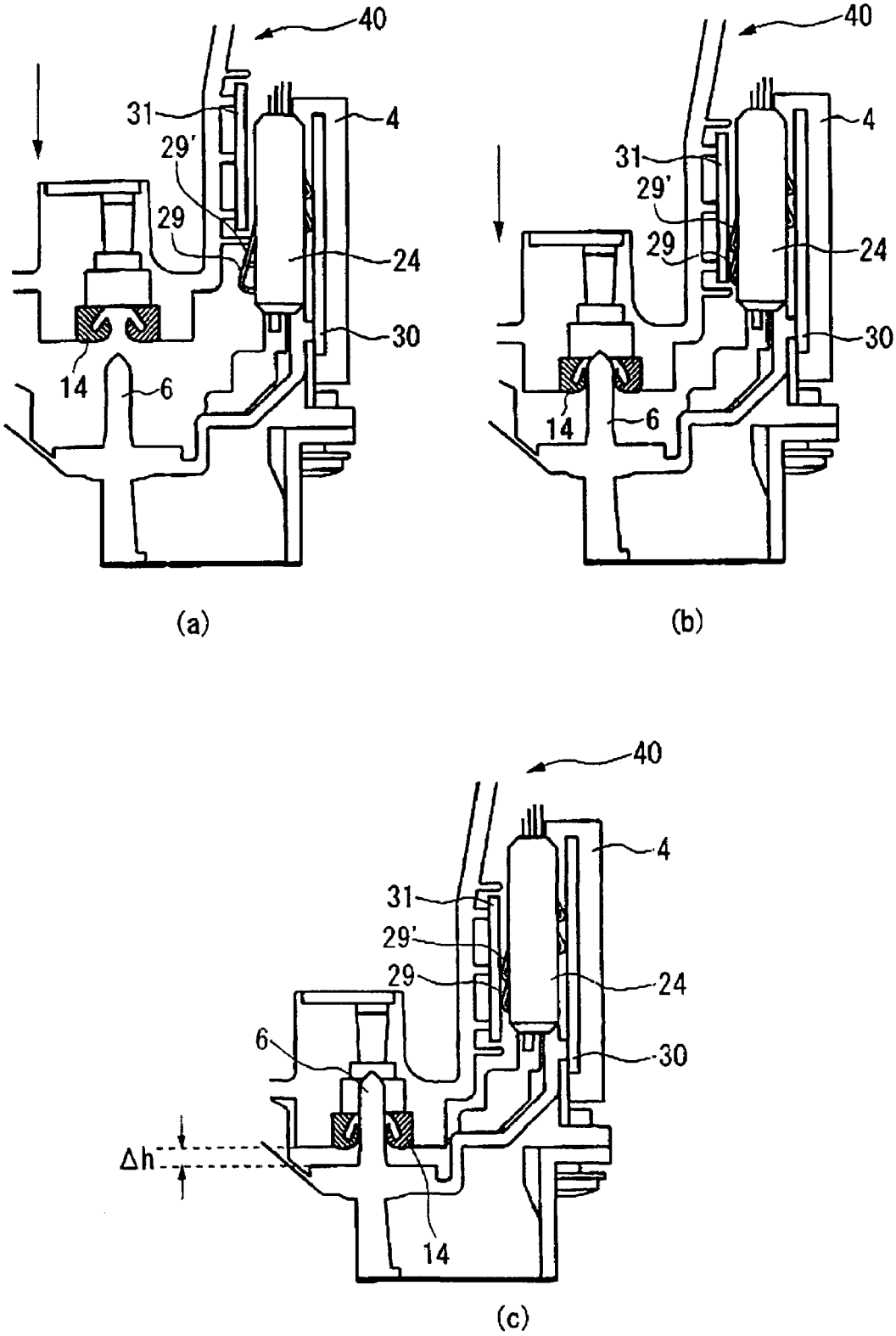

Out of electrodes 60 formed on the circuit board 31, for a small electrode 60-1 shown in FIG. 7(*c*), the height H1 may be 1.8 mm and the width W1 1 mm, for a large electrode 60-2, the height H2 may be 1.8 mm and the width W2 is 3 mm. Particularly, contact with the contact forming members 29 can be secured by forming the small electrode 60-1 in a rectangle in which the length in the inserted direction of the ink cartridge 40 or 50 is longer than that in the other direction, minimizing the width W1 of the electrode even if there is a lift $\Delta h$ between the ink cartridge 40 or 50 and the holder 4 as shown in FIG. 11(*c*).

On the circuit board 31 on which the semiconductor storage means 61 is mounted as described above, at least one through hole 31*a* and a concave portion 31*b* are formed, and projections 45*a*, 45*b*, 55*a* and 55*b* for positioning together with the through hole 31*a* and the concave portion 31*b* and overhangs 45*c*, 45*d*, 55*c* and 55*d* which are elastically in contact with the side of the circuit board 31 such as a rib and a pawl are respectively formed near the ink supply ports 44 and 45 in a direction in which the cartridge is inserted in the vertical direction of the circuit board 31 on the vertical walls 45 and 55 which are respectively the mounting faces of the ink cartridges 40 and 50. In another arrangement, if desired, the circuit board 31 may be provided with at least one projection which engages with a concave portion or through-hole for positioning the circuit board 31 with respect to the ink, cartridge.

Hereby, the circuit board can be readily installed, respectively fitting to the ribs 45*c*, 45*d*, 55*c* and 55*d* by pressing the semiconductor storage means 61 on the respective walls 45 and 55 of the cartridges 40 and 50, regulating the position of the semiconductor storage means according to the projection. Hereby, the cartridge is not required to be thickened uselessly for forming a hole for a screw, filling ink of sufficient quantity is enabled, not screwing fastening in which work is relatively troublesome but not riveting in which work is easy can be applied and a manufacturing process can be simplified. The height of the ribs 45*c*, 45*d*, 55*c* and 55*d* may preferably be higher than a plane of the circuit board 31 when the circuit board is disposed on the ink cartridge, so that the circuit board 31 my be prevented from touching user's finger when he or she mounts the ink cartridge on the printing apparatus.

Figure 8:
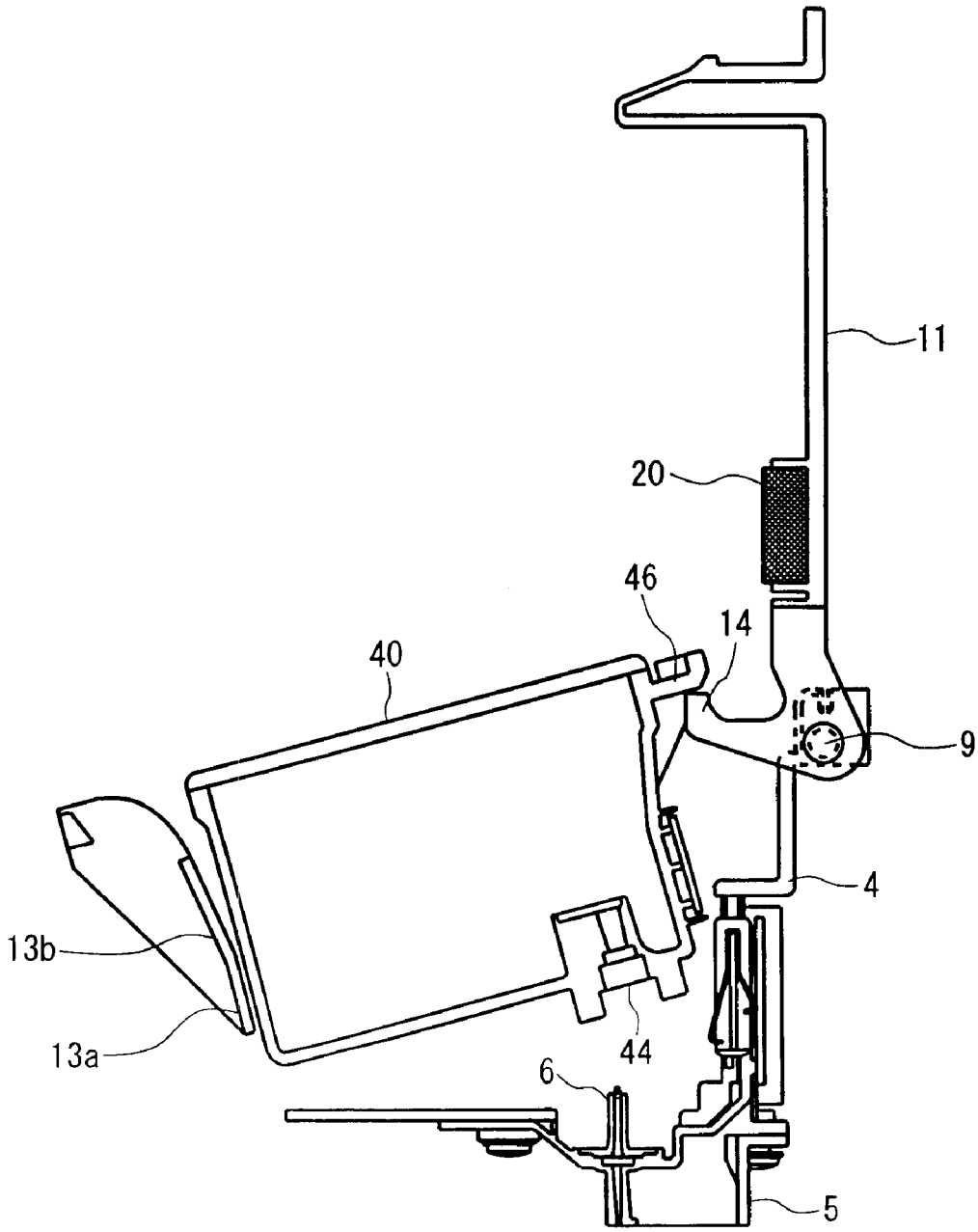
FIGS. 8 and 9 show a process in which the above ink cartridge is installed.

In this embodiment, when the cartridge 40 is installed with the lever 11 lifted up to an approximately vertical position, the overhang 46 formed on the side of the ink supply port is caught by the projection 14 of the lever 11, the side of the other end is supported by the sloped part 13*b* of the holder 4 and held in a state in which the side of the ink supply port is lifted as shown in FIG. 8. In the above installation, if the ink cartridge 40 comes in abutment against the body of the printing apparatus, the circuit board 31 is protected by the overhang portion 46 in the upper part, as the circuit board 31 is also housed in the concave portion 48, no shock directly operates on the circuit board 31 and damage is prevented.

Figure 9:
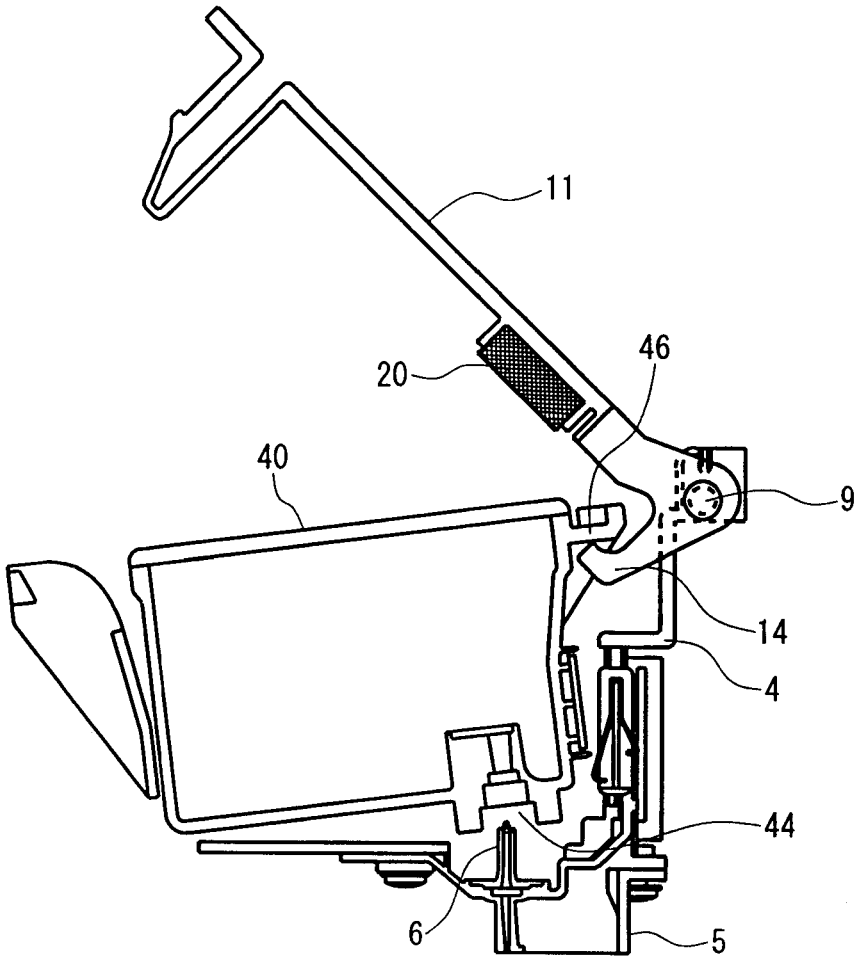

When the lever 11 is closed in this state, the projection 14 is turned downward, the ink cartridge 40 is lowered, approximately keeping the posture when it is installed and the ink supply port 44 comes in contact with the tip end of the ink supply needle 6 as shown in FIG. 9. As shown in FIG. 9, the circuit board 31 is located at an opposite position of a fulcrum of the ink cartridge 40 when it is mounted on or removed from the holder of the printing apparatus. Further, as best shown in FIGS. 6, 8 and 9, the circuit board 31, the ink supply port 44, 54 and the overhang members 46, 56 are located at the same side of the ink cartridges 41, 51, respectively. Owing to such structure, the positioning of the circuit board 31 with respect to the contact member of the printing apparatus is not largely affected by the quantity a of a turn when the ink cartridge 40 is mounted on the holder of the printing apparatus.

As a part over the ink supply port 44 of the cartridge 40 is pressed by the elastic member 20 when the lever 11 is further turned in this state, the ink supply port 44 is pressed on the ink supply needle 6 by pressure amplified based upon the ratio of the length of the lever 11 and distance between the shaft 9 and the elastic member 20. When the lever 11 is pressed to the end, it is fixed by the hook 16 with the lever 11 always elastically pressing the cover 43 of the ink cartridge 40 on the side of the ink supply needle via the elastic member 20 as shown in FIG. 3.

Hereby, the ink cartridge 40 is elastically pressed under fixed pressure with the ink supply port 44 fitted to the ink supply needle 6 and a state in which the ink supply port 44 is fitted to the ink supply needle 6, holding them airtight is maintained independent of vibration in printing, shock and vibration due to the movement of a printing apparatus and others.

As the circuit board 31 is located in the center in the width of the cartridge 40 on the vertical wall 45 in the vicinity of the ink supply port, the vertical wall 45 on which the circuit board 31 is fixed is moved possibly in parallel with a locus on which the ink supply port 44 is regulated by the ink supply needle 6.

Figure 10:
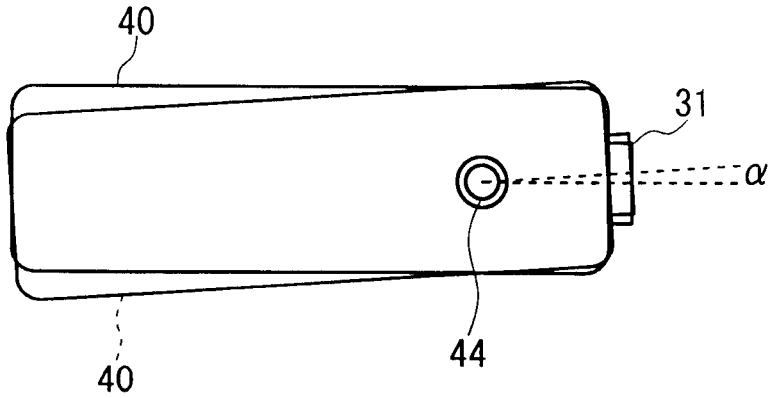
FIG. 10 shows the quantity of the movement of mainly an ink supply port where an ink supply needle is inserted of the ink cartridge, and FIGS. 11(*a*) to 11(*c*) show a process of contact between the circuit board of the ink cartridge and a contact of a holder.

In the meantime, as the circuit board 31 is located in the vicinity of the ink supply needle 6 even if the cartridge 40 rattles when it is installed and a turn is caused with the ink supply needle 6 in the center, the quantity a of a turn is extremely small as shown in FIG. 10.

For the arrangement set forth above, the circuit board 31 is moved according to a preset path as shown in FIG. 11(*a*) to 11(*c*), comes in contact with the contacts 29 and 29' of the contact mechanism 24 in defined order and in order grouped vertically, prevents data from being lost in the semiconductor storage means 61 due to the application of signals in unprepared order, the contact forming members 29 and 29' elastically come in contact with the contact 60 of the circuit board 31 in a state in which the ink cartridge.40 is securely installed, and the reading of data stored in the semiconductor storage means 61 and the writing of data on the side of the printing apparatus are enabled.

When the installation of the ink cartridge 40 or 50 is finished, the contact forming member 29*a* of the contact mechanism 24 comes in contact with the electrodes in the upper row out of the electrodes shown in FIGS. 7(*d*) and 7(*e*) and the contact forming member 29'*a* comes in contact with the electrodes in the lower row. Two contact forming members 29 are in contact with the electrode 60-2 arranged in the center in the lower row. The two contact forming members 29 touched to the electrodes 60-2 are grounded and it can be judged by detecting conduction between these on the side of the printing apparatus whether the ink cartridge 40 or 50 is installed or not. Further, as the width W2 of the electrode 60-2 is larger than that of the other electrode 60-1 and the electrode 60-2 is located on the central line of the ink supply port, the electrode 60-2 securely comes in contact with the contact forming member 29'. As the electrodes 60-1 and 60-2 are exposed and a user can check them easily in case the failure of contact is verified, the electrodes are simply wiped by cloth and others and conduction can be recovered. As shown in FIG. 7, the electrode 60-2 is disposed on the same side of the circuit board 31 as the other electrodes 60-1, 61-1 are formed.

When fitting to the hook 16 is released and the lever 11 is turned upward in case ink in the ink cartridge 40 is consumed, the projection 14 of the lever 11 is fitted to the lower part of the overhang portion 46 of the ink cartridge in the process as shown in FIG. 9. When the lever 11 is further turned in this state, the ink cartridge 40 is lifted by the lever 11 and fitting to the ink supply needle 6 is released. As the upper half of the ink cartridge 40 is exposed from the holder with the overhang 46 on the side of the ink supply port supported by the projection 14 of the lever 11 as shown in FIG. 8 when the turn of the lever 11 up to an approximately vertical position is finished, the ink cartridge can be easily extracted.

Figure 12:
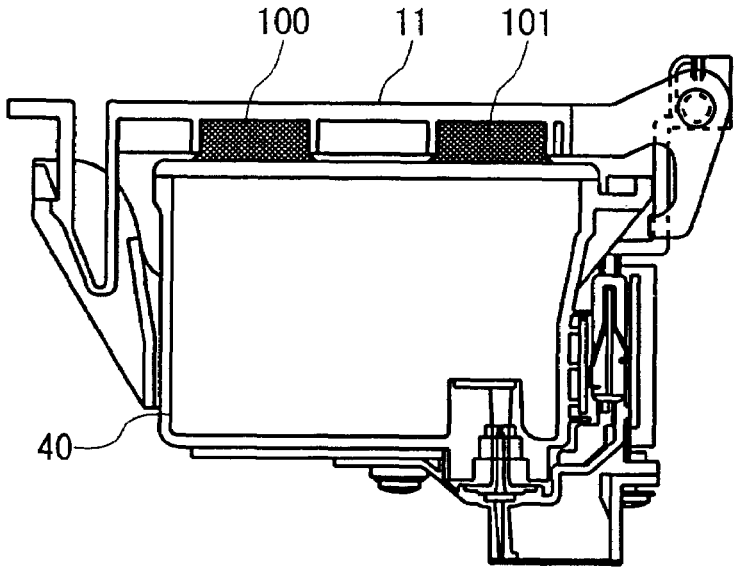
FIGS. 12(*a*), 12(*b*) to FIGS. 14(*a*) and 14(*b*) are respectively sectional views and top views showing another embodiment of the present invention in a state in which the ink cartridge is installed.
Figure 12:
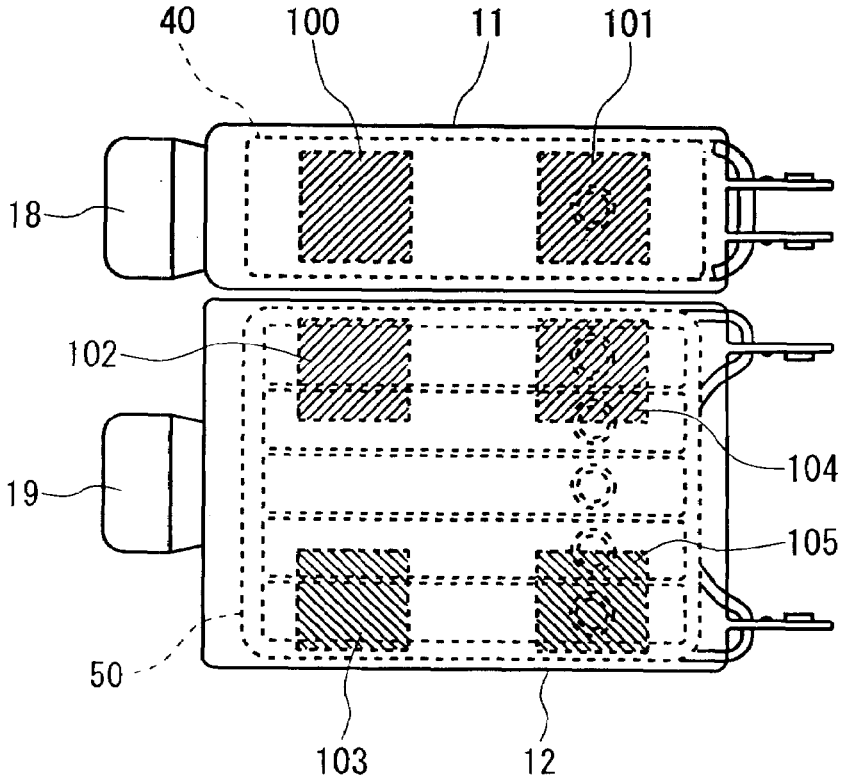

In the above embodiment, only the side of the ink supply port is pressed, however, it is more effective that elastic members 100,101 are provided in two locations in the longitudinal direction of the lever 11 as shown in FIGS. 12(*a*) and 12(*b*) and in the case of the wider cartridge 50 for color ink, elastic members 102 to 105 are provided in four locations, dispersing the elastic members in the direction of the width of the lever 12.

Figure 13:
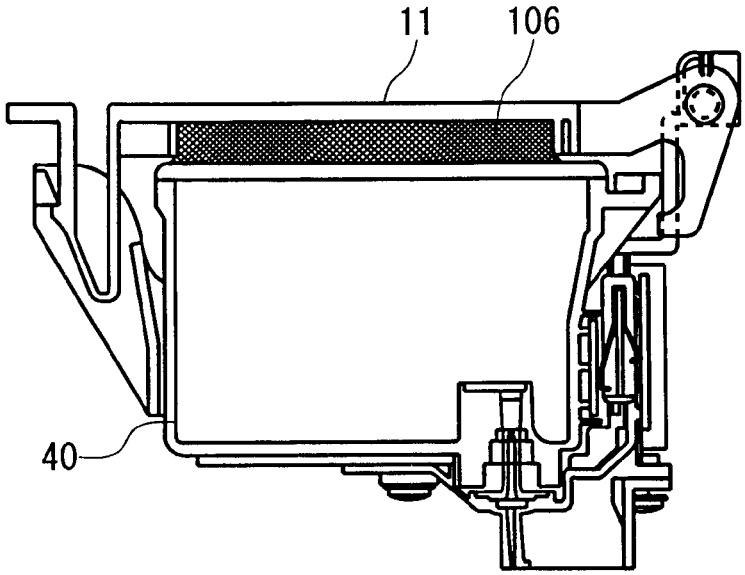
Figure 13:
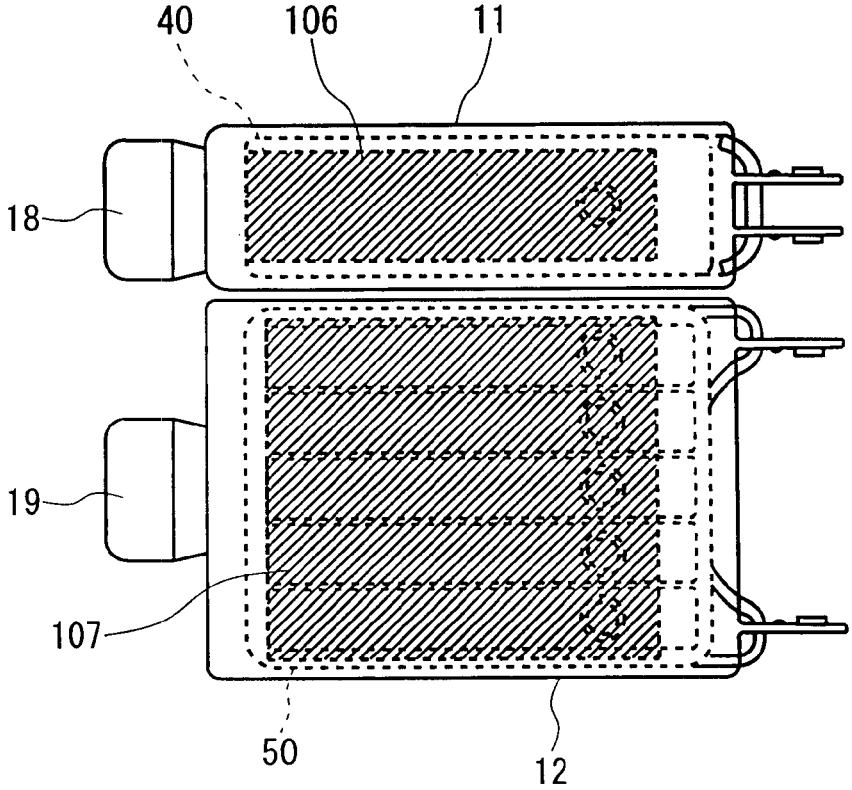

As shown in FIG. 13, when elastic members 106 and 107 in size covering the approximately overall face are mounted, the cartridges 40 and 50 can be more securely held by large frictional force. In this case, it is desirable that thickness and elastic modules are selected so that pressure on the side of the ink supply port is larger than that in the other area.

Figure 14:
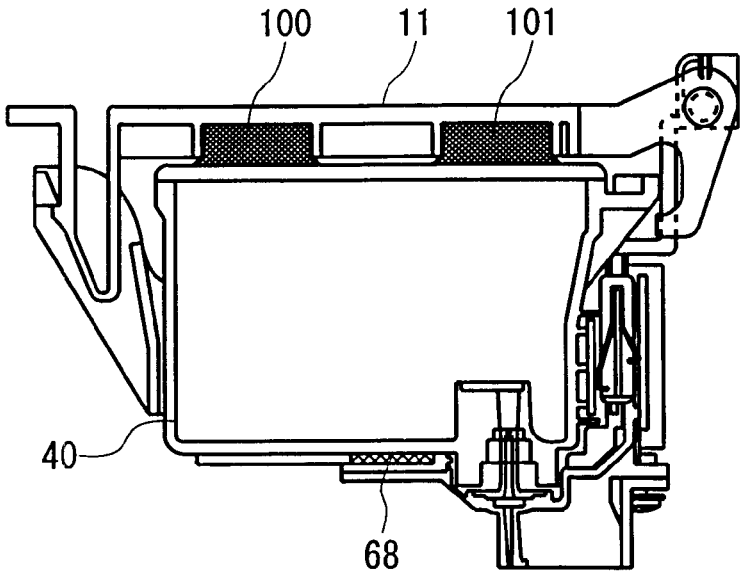
Figure 14:
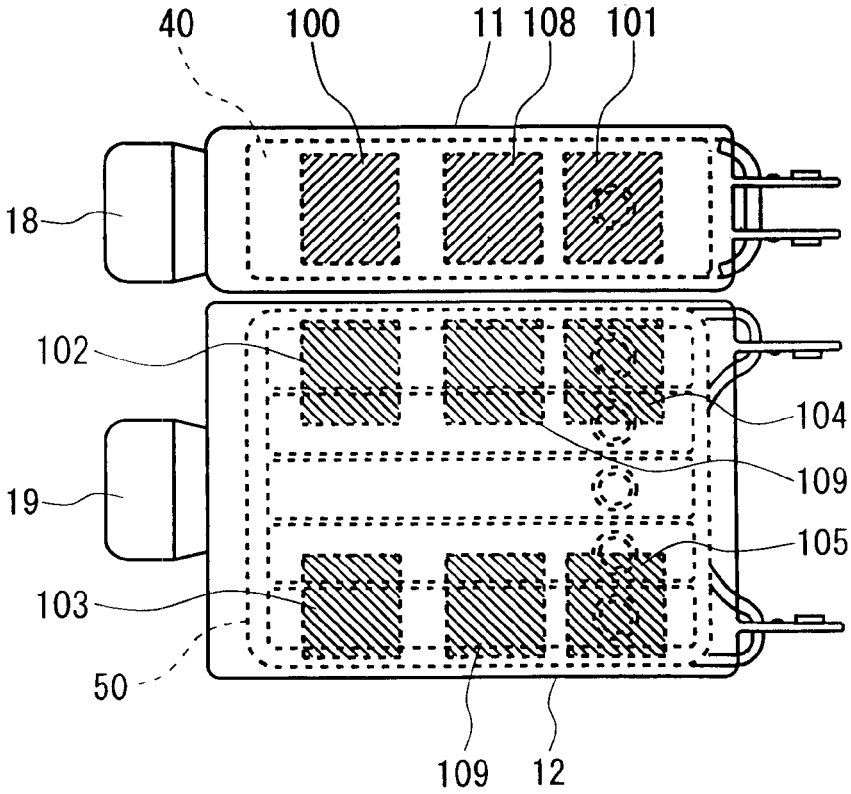

Further, as shown in FIG. 14, if elastic members 108 and 109 similar to the elastic members elastically pressing the upper surface are laid approximately in the center of the bottom of the holder 4, airtight capability between the ink supply port 44 or 54 and the ink supply needle 6 or 7 of the ink cartridge 40 or 50 can be maintained independent of vibration and shock.

Figure 15:
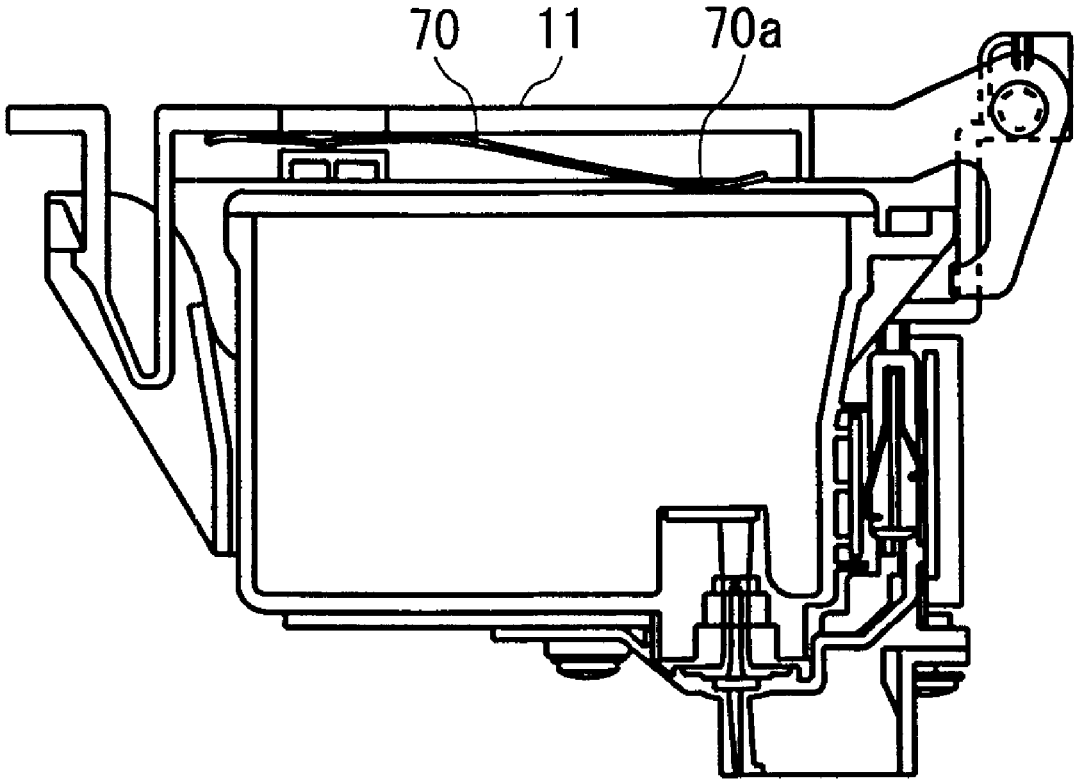
FIG. 15 is a sectional view showing another embodiment of the present invention in a state in which the ink cartridge is installed.

Further, even if at least one plate spring 70 protruded at least on the side of the ink supply port is fixed to the side of a free end at the back of the lever 11 as shown in FIG. 15, the ink cartridge 40 can be fixed in the holder. In this case, it is more effective that non-slip and others are stuck on the side of the free end 70*a* of the plate spring 70 or on the cover of the ink cartridge.

Figure 16:
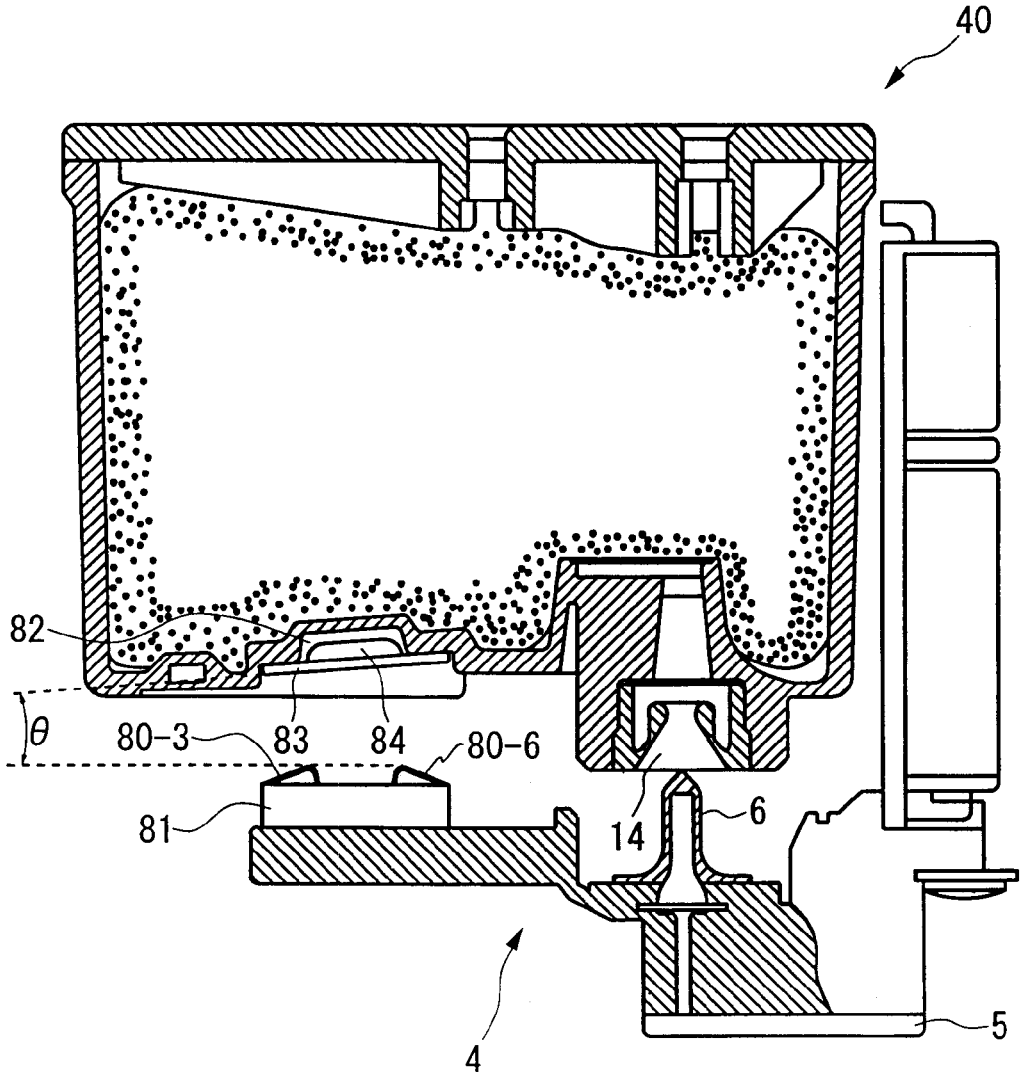
FIG. 16 is a sectional view showing another embodiment of the head holder and the ink cartridge respectively in the above printing apparatus, FIGS. 17(*a*) and 17(*b*) are respectively a plan and a side view showing an embodiment of the contact provided to the above head holder, and FIGS. 18(*a*) to 18(*c*) are respectively a front view, a side view and a rear view showing a contact board mounted on the above ink cartridge.
Figure 17:
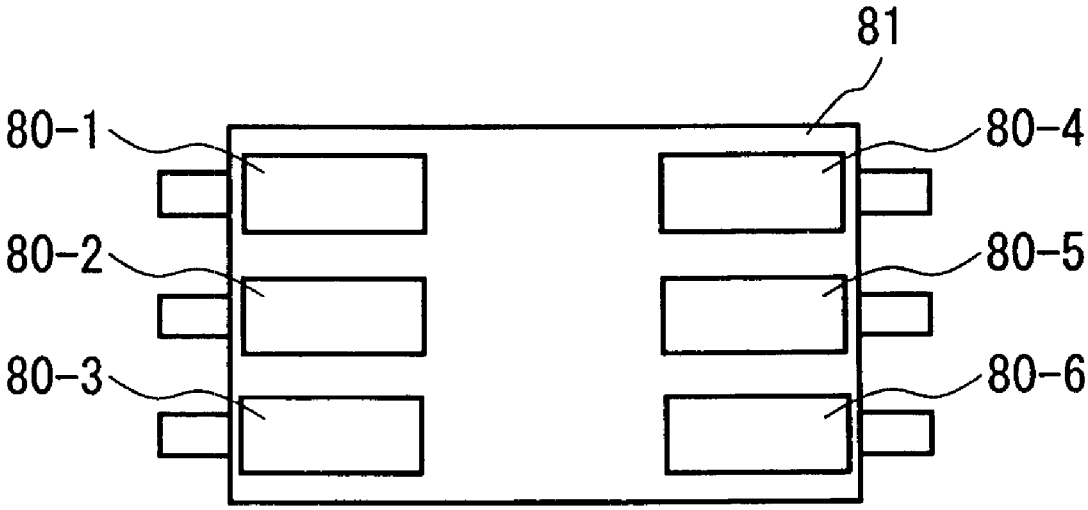
Figure 17:
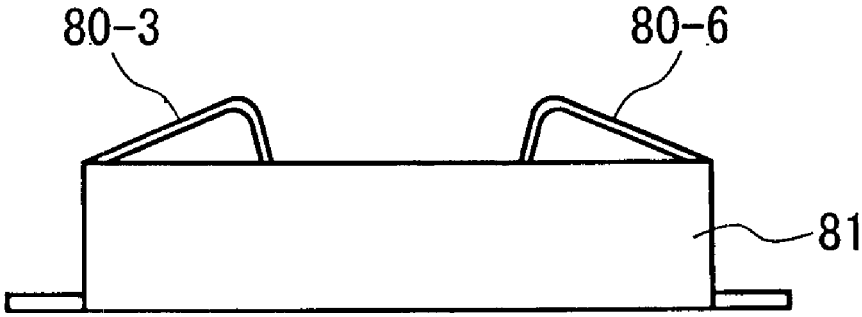

FIG. 16 shows an embodiment in case a circuit board is arranged at the bottom in the vicinity of an ink supply port or an ink cartridge, an ink supply needle 6 communicating with a print head 5 is planted at the bottom of a carriage and a board 81 on which elastically transformable contacts 80-1, 80-2, . . . 80-6 formed by a spring are formed is provided in a position possibly adjacent to the ink supply needle 6 as shown in FIGS. 17(*a*) and 17(*b*).

In the meantime, an ink supply port 14 which can be fitted to the ink supply needle 6 is provided at the bottom of an ink cartridge 40, a concave portion 82 is formed in a position possibly close to the ink supply port 14 and in a position opposite to the contact board 81 and a circuit board 83 is fixed diagonally so that the circuit board has an angle θ with each vertex of the contacts 80-1 to 80-6. It is preferable that the circuit board 83 may be diagonal with respect to a plane perpendicular to a direction in which the ink cartridge is mounted on the printing apparatus.

Figure 18:
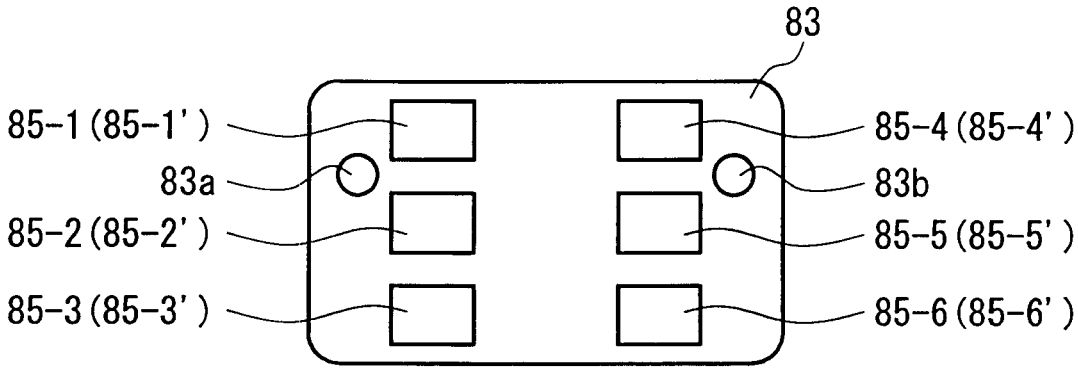
Figure 18:
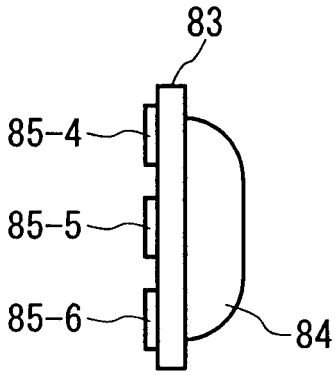
Figure 18:
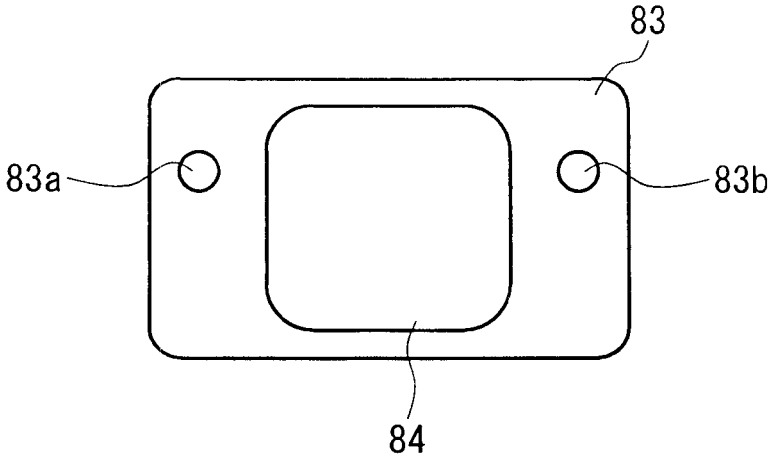

Through holes 83*a* and 83*b* for a positioning are formed on the circuit board 83 as shown in FIG. 18(*a*), semiconductor storage means 84 is mounted on the surface on the side of an ink housing chamber, that is, at the back as shown in FIGS. 18(*b*) and 18(*c*) and contacts 85-1, 85-2, . . . 85-6 connected to the data input terminal and the driving power supply terminal of the semiconductor storage means 84 for acquiring conduction to the contacts 80-1 to 80-6 on the side of the carriage, are formed on the side of the exposed surface.

As the semiconductor storage means 84 is mounted at the rear surface of the circuit board 83 as described above, the degree of freedom in arranging the contacts is enhanced. The surface and the rear of the circuit board 83 can be effectively utilized and electrodes to be the contacts 85-1, 85-2, . . . 85-6 can be formed in area to the extent that the reliability of connection can be secured. A molding agent can be readily applied to the surface on which the semiconductor storage means 84 is formed without considering whether application precision is high or not to prevent from adhering to the contacts 85-1, 85-2, . . . 85-6 and the manufacturing process can be simplified.

Further, because the semiconductor storage means 84 is mounted on the cartridge with the status hidden by the circuit board 83, a user can be prevented from touching to the storage means unintentionally, liquid such as ink can be prevented from adhering to the storage means, and electrostatic destruction and an accident caused by a short circuit can be also prevented.

The semiconductor storage means 84 is connected to control means not shown of the printing apparatus via the contacts 85-1, 85-2, . . . 85-6 and the contacts 80-1 to 80-6, data stored in the semiconductor storage means is read and data such as the quantity of ink consumed by printing operation is written to the means.

In another arrangement, the circuit board 83 may be diagonal with respect to a direction in which the ink cartridge 40 is mounted on the printing apparatus.

Figure 19:
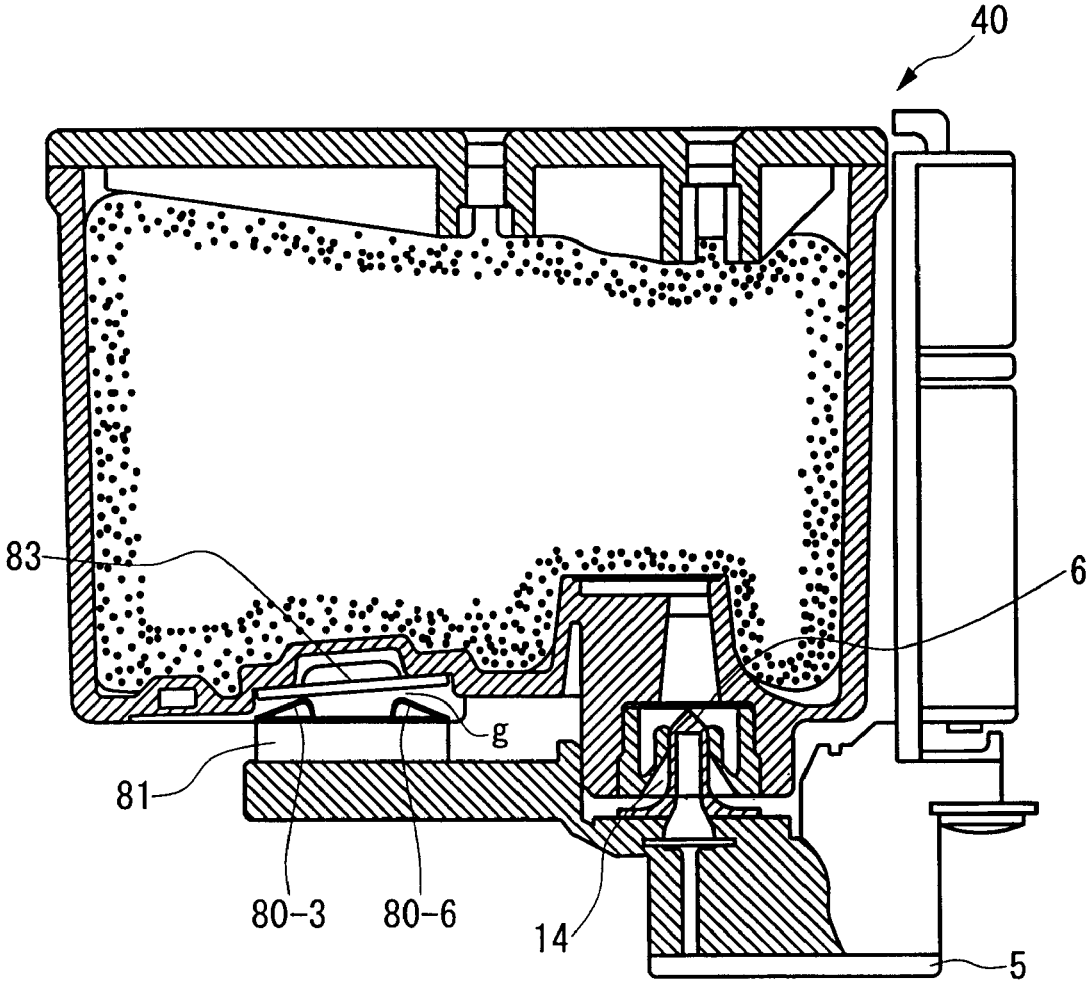
FIG. 19 is a sectional view showing first conduction in a process for inserting the ink cartridge, and FIG. 20(*a*) is a plan showing the other embodiment of the contact mounted on the above ink cartridge and FIG. 20(*b*) shows a state in which ink adheres.

In this embodiment, when the ink cartridge 40 reaches the vicinity of the bottom of the carriage in case the ink cartridge 40 is installed, the ink supply needle 6 enters the ink supply port 14 as shown in FIG. 19, forms a passage, the contacts 80-1 to 80-3 near one side of the circuit board 83 having an angle θ with a horizontal plane first come in contact with the contacts 85-1 to 85-3 and conduction is acquired.

When the cartridge 40 further is further lowered, the contacts 80-4 to 80-6 near the other side of the circuit board 83 come into contact with the contacts 85-4 to 85-6 and all contacts become conduction.

Therefore, power is supplied to the semiconductor storage means 84 through the contacts 80-1 to 80-3 and the contacts 85-1 to 85-3 by which conduction is first acquired so as to initialize the semiconductor storage means 84. Data can be prevented from being lost by accessing to data stored in the semiconductor storage means 84 via the contacts 80-4 to 80-6 and the contacts 85-4 to 85-6 which become conduction after the above conduction is acquired.

In the meantime, when the ink cartridge 40 is pulled out from the carriage, termination processing can be executed by power still supplied by the contacts 80-1 to 80-3 and the contacts 85-1 to 85-3 and afterward, power can be turned off through the contacts 80-4 to 80-6 and the contacts 85-4 to 85-6 are first disconnected. When processing for the semiconductor storage means 84 finishes as described above, the ink supply needle 6 is pulled out from the ink supply port 14.

Figure 20:
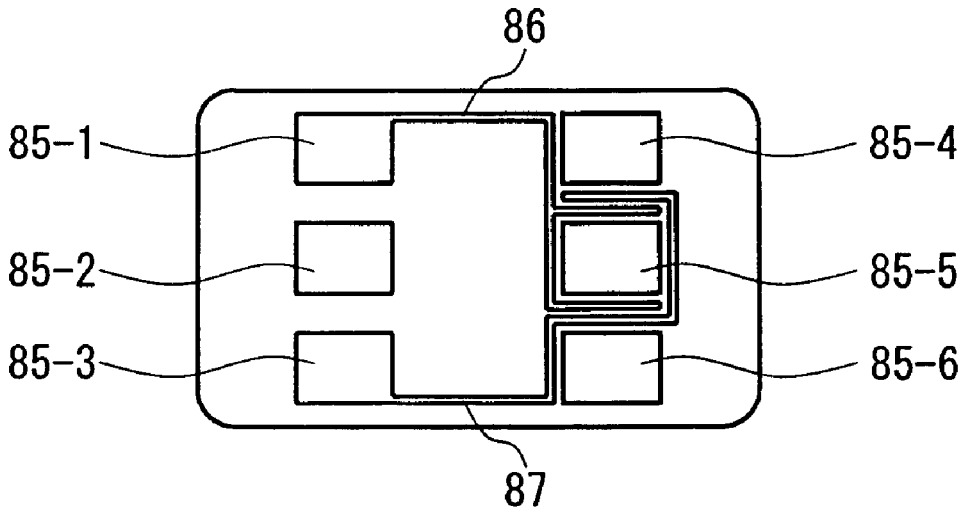
Figure 20:
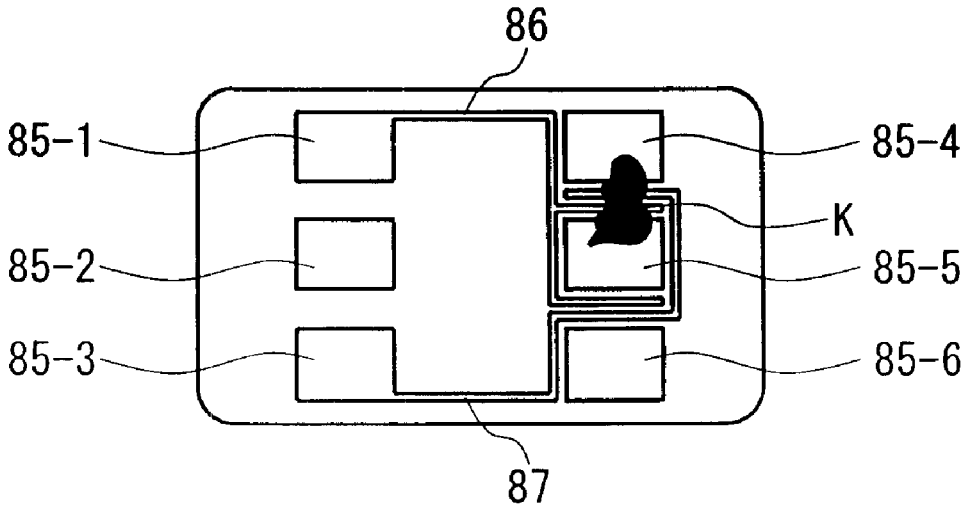

FIG. 20(*a*) shows the other embodiment of contacts 85-1 to 85-5 formed in an ink cartridge 40. Conductive patterns 86 and 87 are formed between a column of contacts 85-1 to 85-3 by which conduction is first acquired when the ink cartridge 40 is inserted and a column of contacts 85-4 to 85-5 by which conduction is afterward acquired.

For example, the contacts 85-1 and 85-3 are selected as a detection terminal and two of the contacts 85-4 to 85-5, that is, 85-4 and 85-5 may be selected as a power supply terminal.

In the arrangement described above, if ink K adheres across the terminals 85-4 and 85-5, serving as a power supply terminal as shown in FIG. 20(*b*), resistance between the terminals 85-4 and 85-5 is detected by the contacts 85-1 and 85-3, by which conduction is first acquired together with the contacts 80-1 and 80-3 of the holder 4 when the ink cartridge is inserted. If the detected resistance is lower than a predetermined value, the supply of power to 80-4 and 80-5 by which conduction is next acquired together with the power supply terminals 85-4 and 85-5 is stopped and an accident caused by a short circuit due to the adhesion of ink K can be precluded.

Figure 21:
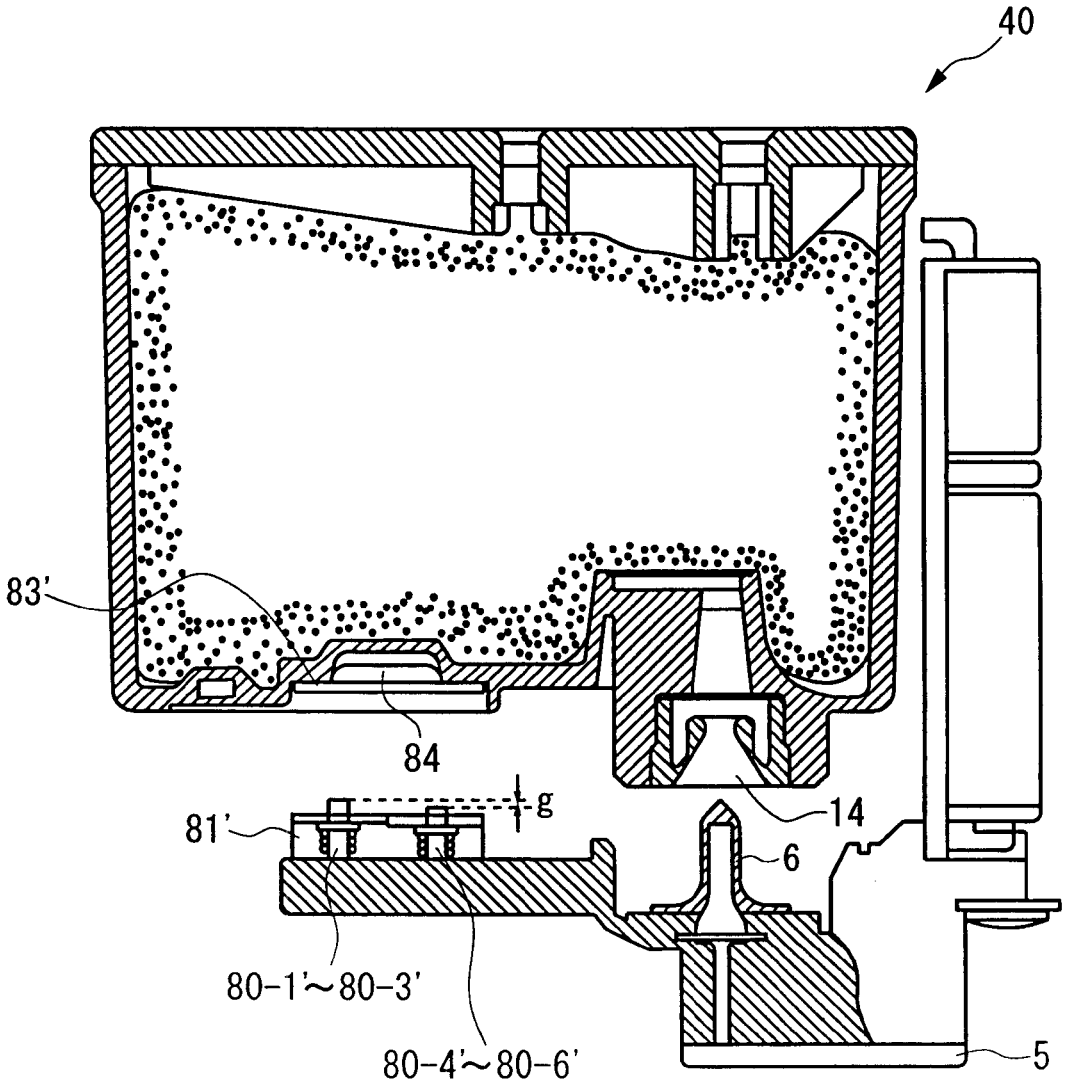
FIG. 21 is a sectional view showing the other embodiment of the head holder and the ink cartridge respectively in the printing apparatus according to the present invention.

FIG. 21 shows another preferred embodiment of the present invention in which a circuit board 83' on which contacts 85-1' to 85-6' formed such as to be secured horizontally at the bottom of an ink cartridge 40 while the circuit board is always pressed upward by a spring or the like. A board 81' on which two columns of contacts 80-1' to 80-3' and contacts 80-4' to 80-6' are formed is formed in such a manner that difference g in a level is made between the tip ends of the two columns is provided.

Figure 22:
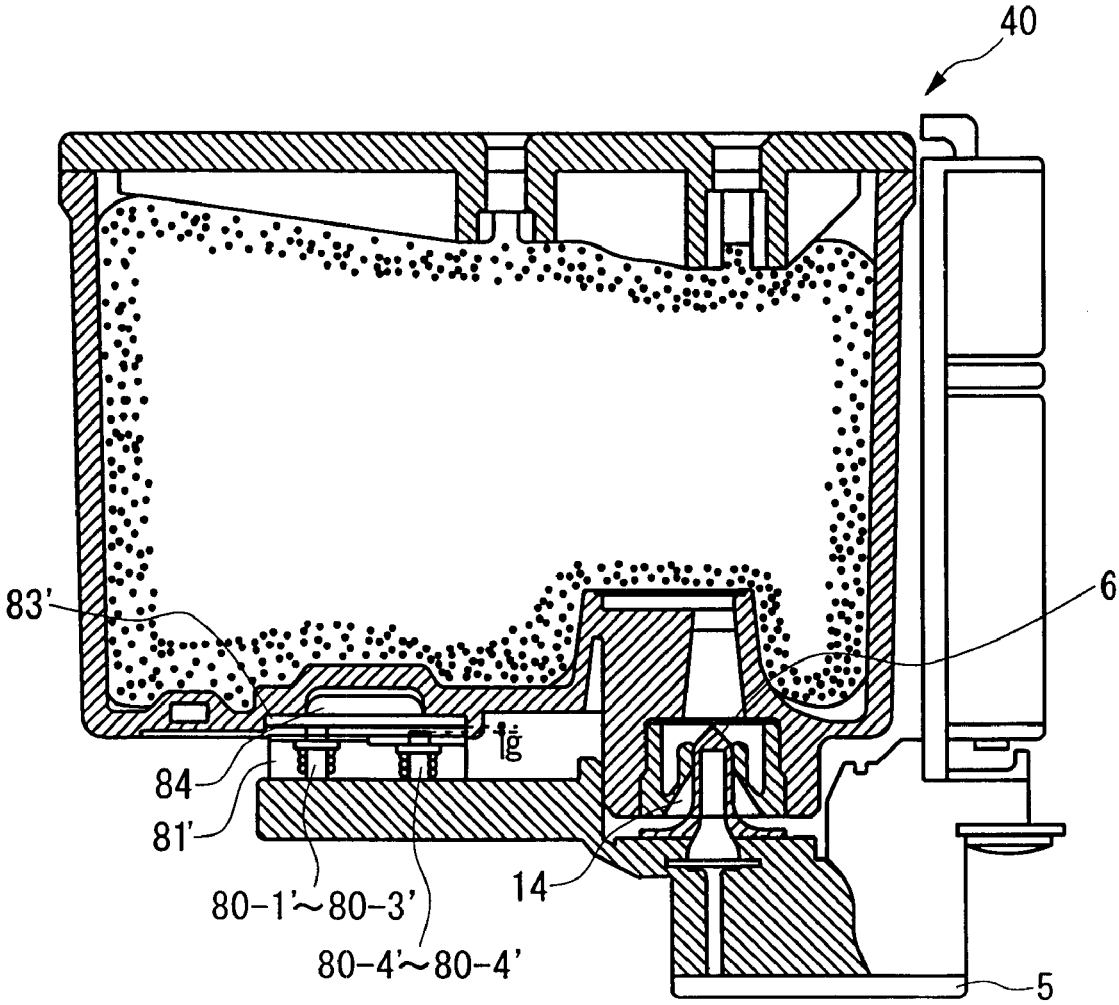
FIG. 22 is a sectional view showing first conduction in the process for inserting the ink cartridge in the above printing apparatus.

Also in this embodiment, as shown in FIG. 22, as the first column of contacts 85-1' to 85-3' and the contacts 80-1' and 80-3' first become conduction. Next, the second column of contacts 80-4' to 80-6' respectively short in a stroke come in contact with the contacts 85-4' and 85-6' and conduction is acquired, so that the similar action and effect to those in the above embodiments are produced.

Figure 23:
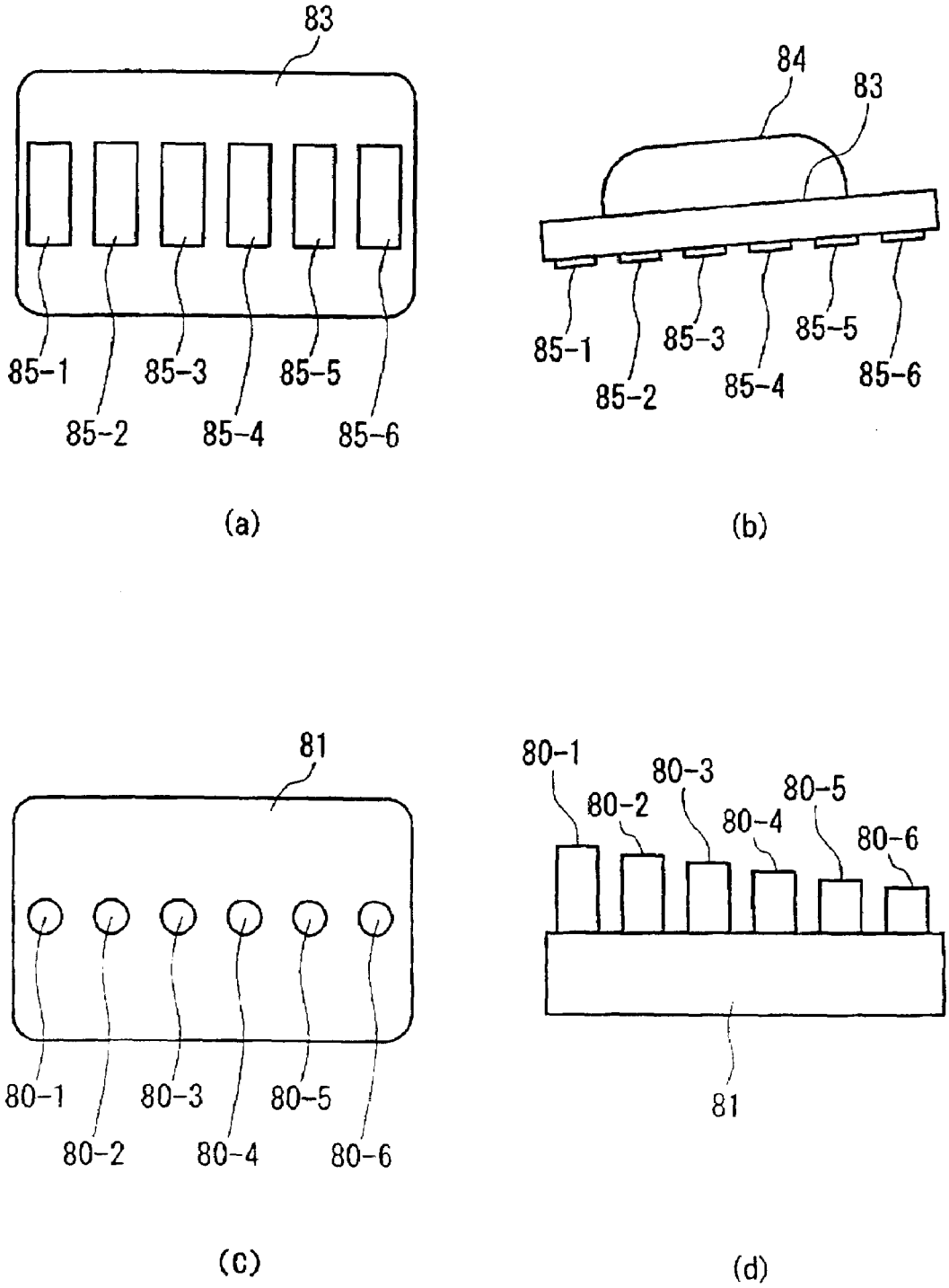
FIGS. 23(*a*) to 23(*d*) are respectively plans and side views showing the other embodiment of the present invention in relation to the arrangement of the contacts, and FIGS. 24(*a*) and 24(*b*) are respectively sectional views showing another embodiment of the mounting of the circuit board on the ink cartridge and a top view showing the structure of a mounting plate.

In the above embodiment, the contacts 80-1 to 80-6 and 85-1 to 85-6 are divided into plural columns and difference in time until conduction is acquired is provided between the columns. However, it is clear that the similar effect may be realized even if the contacts 80-1 to 80-6 and the contacts 85-1 to 85-6 are respectively arranged in one row as shown in FIGS. 23(*a*) and 23(*b*), and a board 83 on which the contacts 85-1 to 85-6 are formed is angled as shown in FIGS. 23(*c*) and 23(*d*) so that the conducting time becomes different between the contact 80-1 and 85-1 on one side and the contact 80-6 and 85-6 on the other side. Similarly, if the position of each end of the contacts 80-1 to 80-6 is designed to be differentiated, so that the same function may be achieved.

In the above embodiments, the mode according to which the ink cartridge is mounted on the carriage is described as an example. However, it is apparent that a similar effect may be obtained even if the present invention is applied to a printing apparatus of a type in which an ink cartridge is housed in a cartridge housing area of the apparatus body and is connected to a print head via an ink supply tube.

That is, contacts have only to be formed in required positions on the exposed face of the ink cartridge and the above contacts 85-1 to 85-6 have only to be formed in touchable positions opposite to the contacts of the ink cartridge when the ink cartridge is installed.

Figure 24:
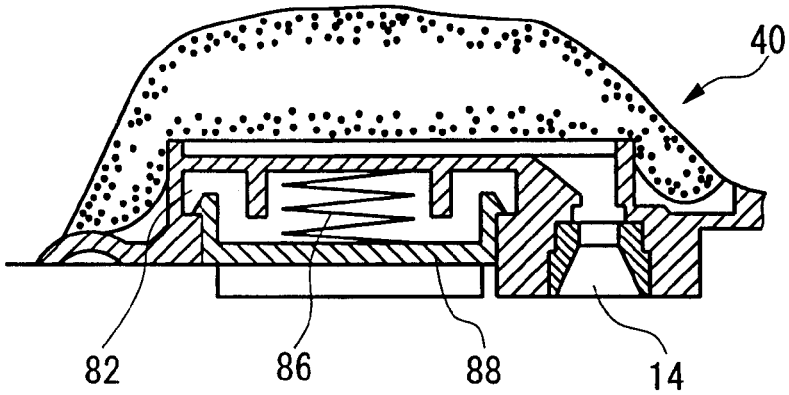
Figure 24:
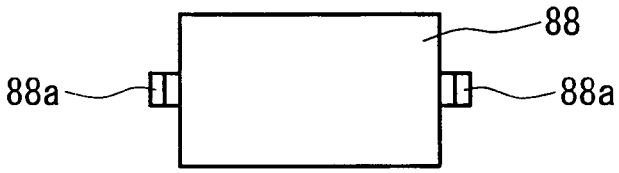
Figure 25:
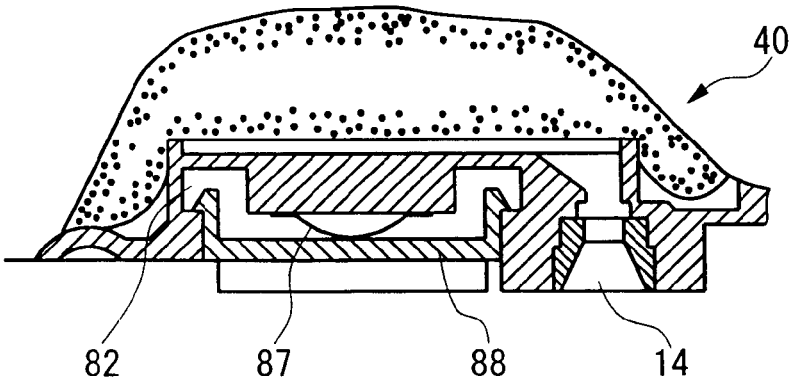
FIG. 25 is a sectional view showing another embodiment of the mounting of the circuit board on the ink cartridge.

In addition, the same effect may be accomplished even in an arrangement in which the board 83 is mounted at the bottom of the ink cartridge 40 via a mounting plate 88 having elastically transformable pawls 88*a* protruding therefrom at least at both ends on the open sides of the mounting plate, after inserting a coil spring 86 or an arcuate plate spring 87 into a concave portion as shown in FIGS. 24 and 25. Alternatively, the same effect may be obtained if the semiconductor storage means 84 is mounted on the mounting plate 88 thereby to form the contacts 85-1, 85-2, . . . 85-6. According to this arrangement, if merely a jig is prepared, the pawls 88*a* can be removed by the jig and the board 83 can be detached from the cartridge 40 in a factory while precluding unnecessary detachment by user.

Further, in the above embodiments, projections for positioning may be formed on the ink cartridge and the circuit board is positioned. However, the similar effect can be achieved in another arrangement in which a concave portion 93*a* is formed on a wall of an ink cartridge 90, a wall 93 adjacent to the bottom 92 on which an ink supply port 91 is formed, in this embodiment as shown in FIG. 26(*a*), a circuit board 83 is housed and fixed in the concave portion 93*a*.

Figure 26:
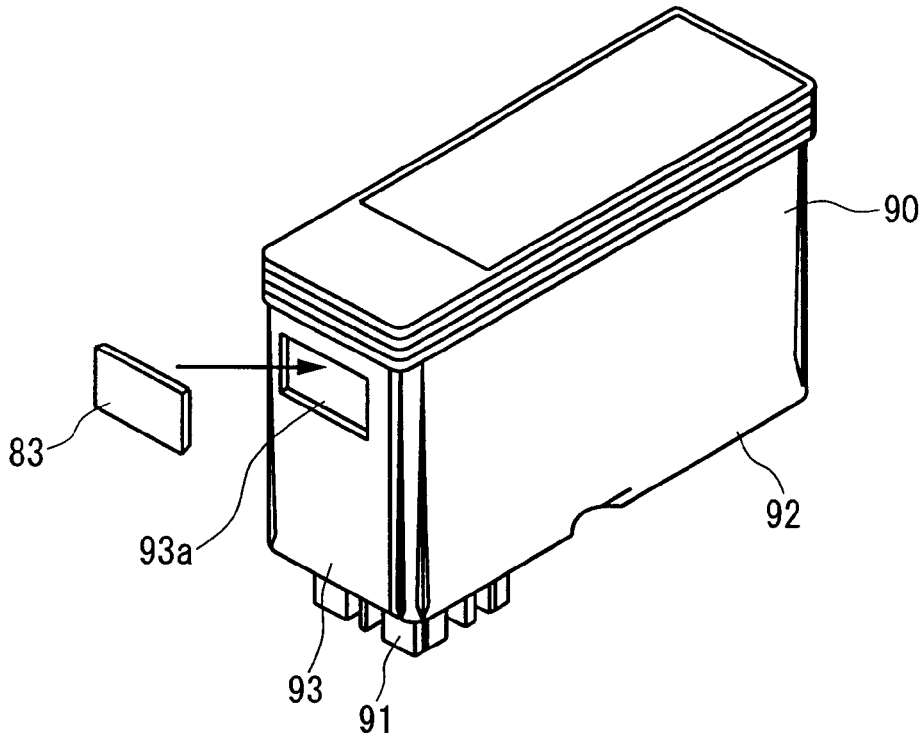
FIG. 26(*a*) and 26(*b*) show the other embodiment of the mounting of the circuit board.
Figure 26:
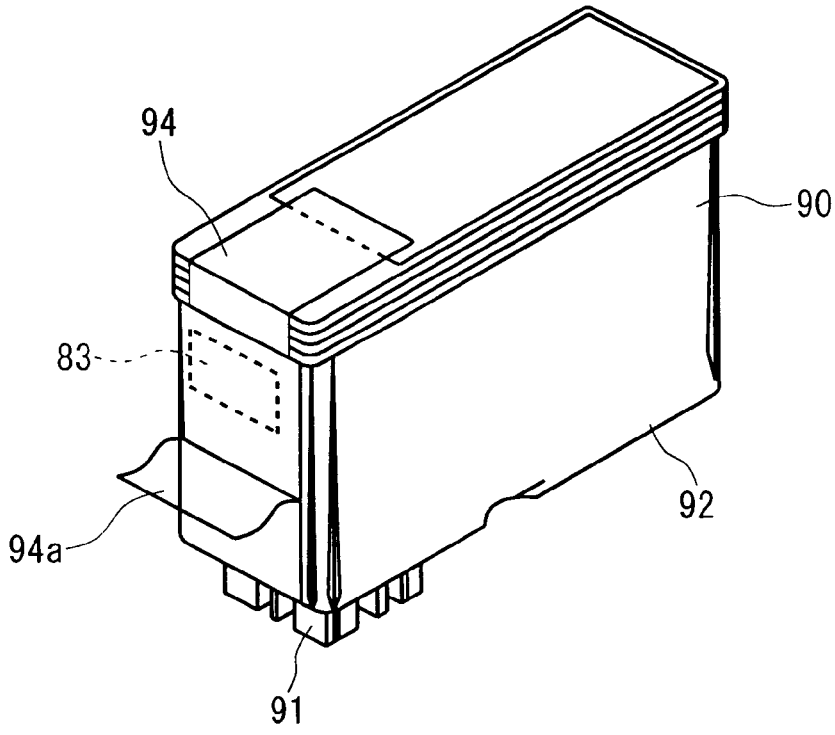

If necessary, a film 94 which can be peeled from one end 94*a* may be also applied as shown in FIG. 26(*b*) and may be also sealed till the start of use.

According to the present invention, as the ink supply needle is located near one side in a direction perpendicular to the direction of the reciprocation of the carriage, the circuit board is mounted on the wall in the vicinity of the side on which the ink supply port is formed of the ink cartridge, the plural contacts for connecting to external control means are formed on the exposed surface of the circuit board and the semiconductor storage means is accessed from the external control means via the contacts, the circuit board is located on the side of the ink supply port and the face on which the circuit board is fixed is moved along the ink supply needle. Therefore, even if there is play between the carriage and the cartridge, the cartridge is moved according to a locus defined by the ink supply needle and the ink supply port, the contacts are connected to the external control means in a defined order and data stored in the semiconductor storage means can be securely prevented from being lost by the application of signals in an unprepared order.

What is claimed is:

1. An ink cartridge mountable in a receptacle of a printing apparatus to supply ink to a print head of the printing apparatus through an ink supply needle, the ink cartridge comprising:

an ink chamber including a plurality of projections;

an ink supply port, formed on a wall of said ink chamber, the ink supply port being configured to receive the ink supply needle; and a circuit board, provided at said ink chamber, and having a plurality of contacts for electrical connection to an external controller, said circuit board including a concave portion and a through hole;

wherein the projections respectively engage said concave portion and said through hole of said circuit board.

2. An ink cartridge according to claim 1, wherein the receptacle of the printing apparatus moves during a printing operation.

3. An ink cartridge mountable in a receptacle of a printing apparatus to supply ink to a print head of the printing apparatus through an ink supply needle, the ink cartridge comprising:

an ink chamber including a plurality of projections;

an ink supply port, formed on a wall of said ink chamber, the ink supply port being configured to receive the ink supply needle; and a circuit board, provided at said ink chamber, and having a plurality of contacts for electrical connection to an external controller, said circuit board including at least one of a concave portion and a through hole;

wherein at least one said projection engages at least a portion of said at least one of said concave portion and said through hole, and said circuit board is joined to said ink chamber by hot riveting.

4. An ink cartridge according to claim 3, wherein the receptacle of the printing apparatus moves during a printing operation.

* * * * *